US007736024B2

(12) United States Patent
Gordin et al.

(10) Patent No.: US 7,736,024 B2
(45) Date of Patent: Jun. 15, 2010

(54) GEARED TILT MECHANISM FOR ENSURING HORIZONTAL OPERATION OF ARC LAMP

(75) Inventors: Myron K Gordin, Oskaloosa, IA (US); Timothy J. Boyle, Oskaloosa, IA (US)

(73) Assignee: Mucso Corporation, Oskaloosa, IA (US)

( * ) Notice: Subject to any disclaimer, the term of this patent is extended or adjusted under 35 U.S.C. 154(b) by 45 days.

(21) Appl. No.: 12/165,212

(22) Filed: Jun. 30, 2008

(65) Prior Publication Data

US 2009/0002993 A1 Jan. 1, 2009

Related U.S. Application Data

(63) Continuation of application No. 11/332,938, filed on Jan. 17, 2006, now Pat. No. 7,452,108.

(60) Provisional application No. 60/644,536, filed on Jan. 18, 2005, provisional application No. 60/644,639, filed on Jan. 18, 2005, provisional application No. 60/644,747, filed on Jan. 18, 2005, provisional application No. 60/644,534, filed on Jan. 18, 2005, provisional application No. 60/644,720, filed on Jan. 18, 2005, provisional application No. 60/644,688, filed on Jan. 18, 2005, provisional application No. 60/644,636, filed on Jan. 18, 2005, provisional application No. 60/644,517, filed on Jan. 18, 2005, provisional application No. 60/644,609, filed on Jan. 18, 2005, provisional application No. 60/644,516, filed on Jan. 18, 2005, provisional application No. 60/644,546, filed on Jan. 18, 2005, provisional application No. 60/644,547, filed on Jan. 18, 2005, provisional application No. 60/644,638, filed on Jan. 18, 2005, provisional application No. 60/644,537, filed on Jan. 18, 2005, provisional application No. 60/644,637, filed on Jan. 18, 2005, provisional application No. 60/644,719, filed on Jan. 18, 2005, provisional application No. 60/644,784, filed on Jan. 18, 2005, provisional application No. 60/644,687, filed on Jan. 18, 2005.

(51) Int. Cl.
*F21V 19/02* (2006.01)

(52) U.S. Cl. ..... 362/285; 362/418; 362/263

(58) Field of Classification Search ..... 362/350, 362/263, 285–287, 418, 419, 422–425
See application file for complete search history.

(56) References Cited

U.S. PATENT DOCUMENTS 2,447,923 A 6/1948 Tuck (Continued)

FOREIGN PATENT DOCUMENTS

EP 1 172 839 A2 1/2002

(Continued)

*Primary Examiner*—Bao Q Truong
(74) *Attorney, Agent, or Firm*—McKee, Voorhees & Sease, P.L.C.

(57) ABSTRACT

An apparatus and method for keeping a high intensity discharge arc tube relatively horizontal in a light fixture regardless of aiming orientation of the light fixture towards a target. In one aspect, the light source is mounted in an independently pivotal yoke in the light fixture. A gearing arrangement automatically proportionally pivots the light source relative to any pivoting motion of the fixture over a range of motion such that a selected light source orientation can be approximately maintained regardless of aiming orientation of the fixture.

7 Claims, 52 Drawing Sheets

U.S. PATENT DOCUMENTS

| | | | | |
|---|---|---|---|---|
| 4,173,037 | A | 10/1979 | Fletcher et al. | |
| 4,729,077 | A * | 3/1988 | Gordin et al. | 362/285 |
| 4,816,974 | A | 3/1989 | Gordin | |
| 4,947,303 | A | 8/1990 | Gordin et al. | |
| 5,161,883 | A | 11/1992 | Gordin et al. | |
| 5,600,537 | A | 2/1997 | Gordin et al. | |
| 5,816,691 | A | 10/1998 | Gordin et al. | |
| 5,856,721 | A | 1/1999 | Gordin et al. | |
| 6,036,338 | A | 3/2000 | Gordin | |
| 6,203,176 | B1 | 3/2001 | Gordin | |
| 6,733,159 | B1 | 5/2004 | Wu | |
| 7,452,108 | B2 * | 11/2008 | Gordin et al. | 362/285 |
| 2003/0117805 | A1 | 6/2003 | Pasternak et al. | |

FOREIGN PATENT DOCUMENTS

| | | |
|---|---|---|
| WO | 2006002072 | 5/2006 |

* cited by examiner

FRONT VIEW

TOP VIEW

SECTION A-A

SIDE VIEW

VIEW C-C

VIEW E-E

SECTION F-F

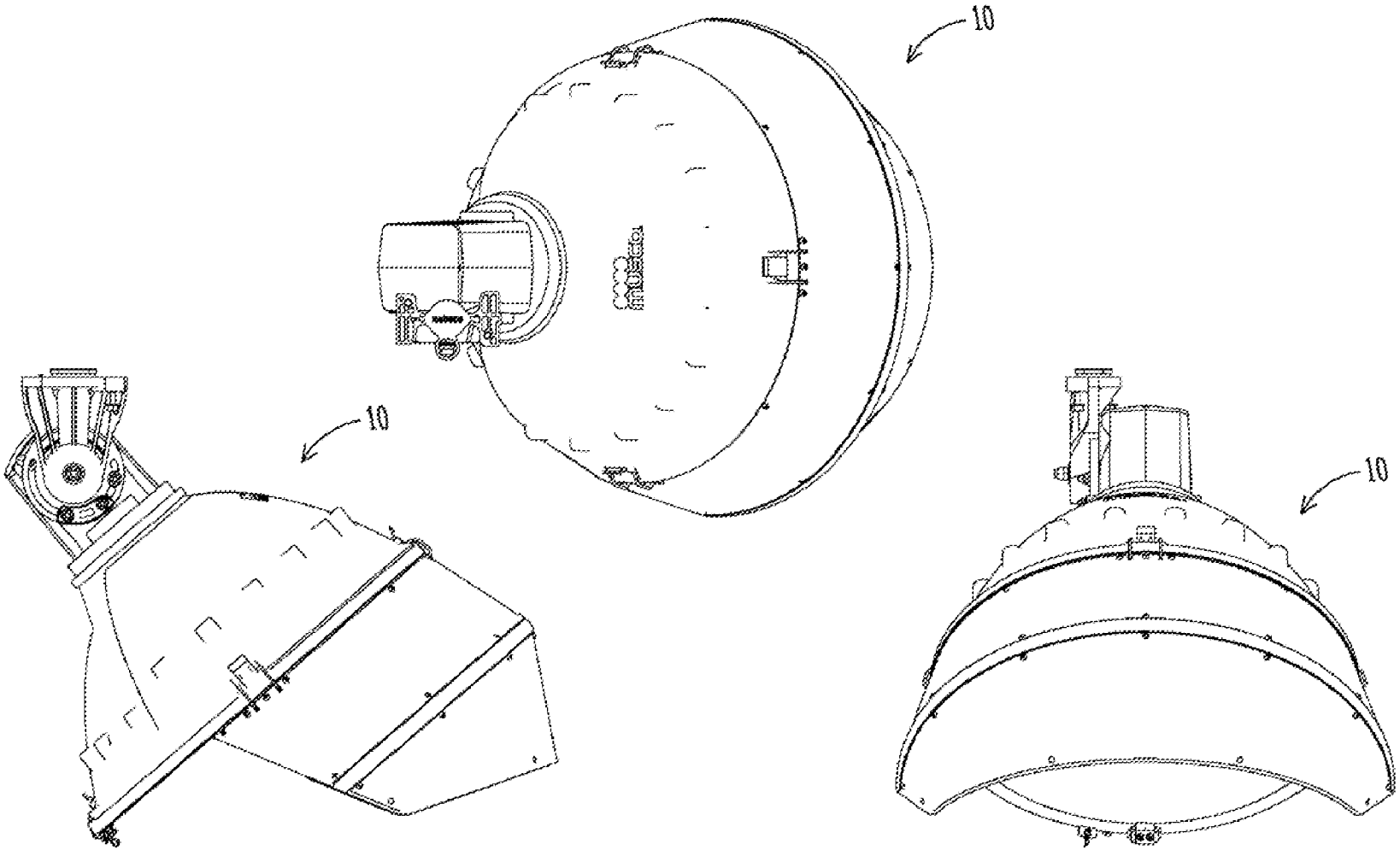
Fig. 5G1

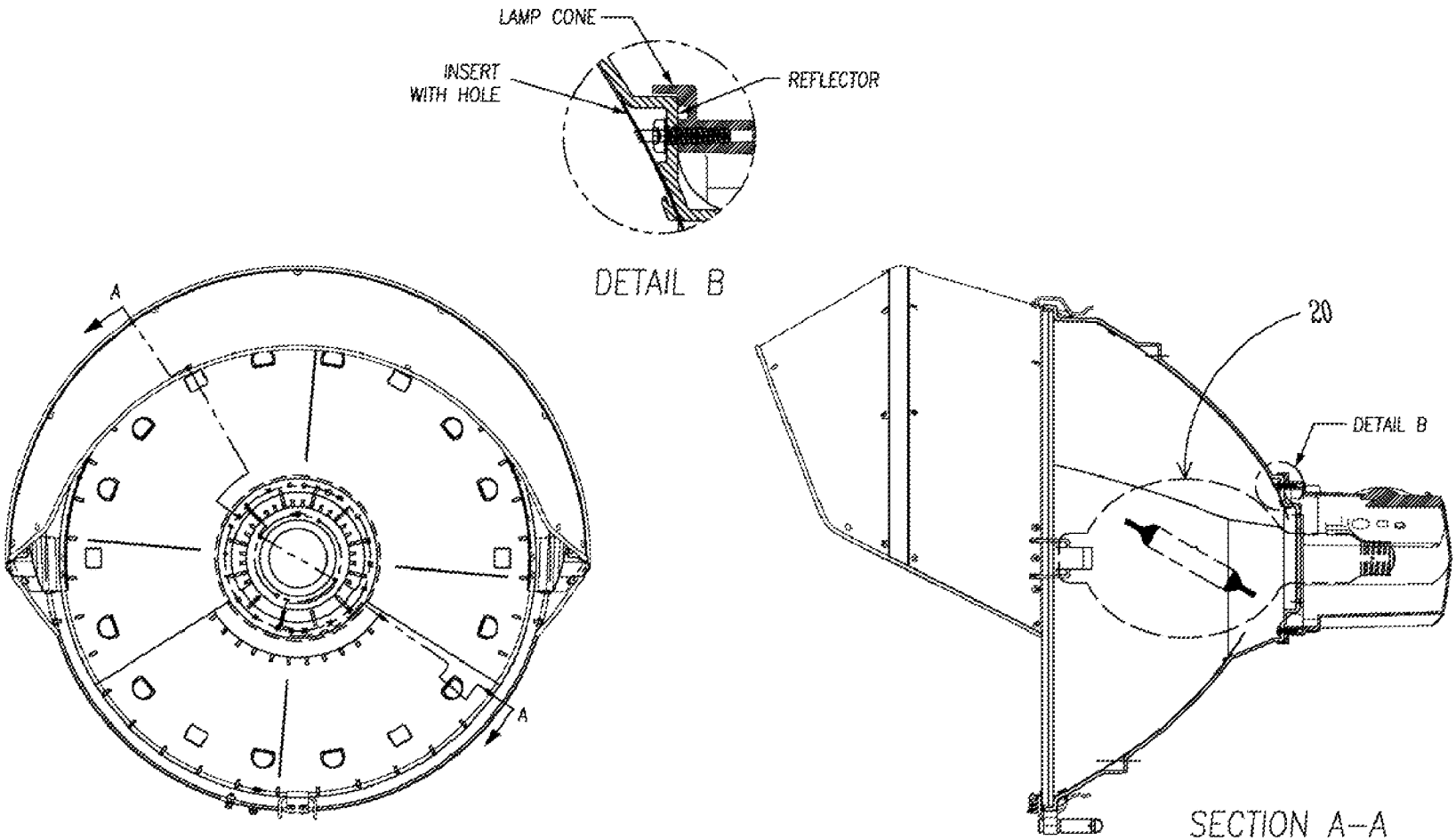
Fig. 5C2

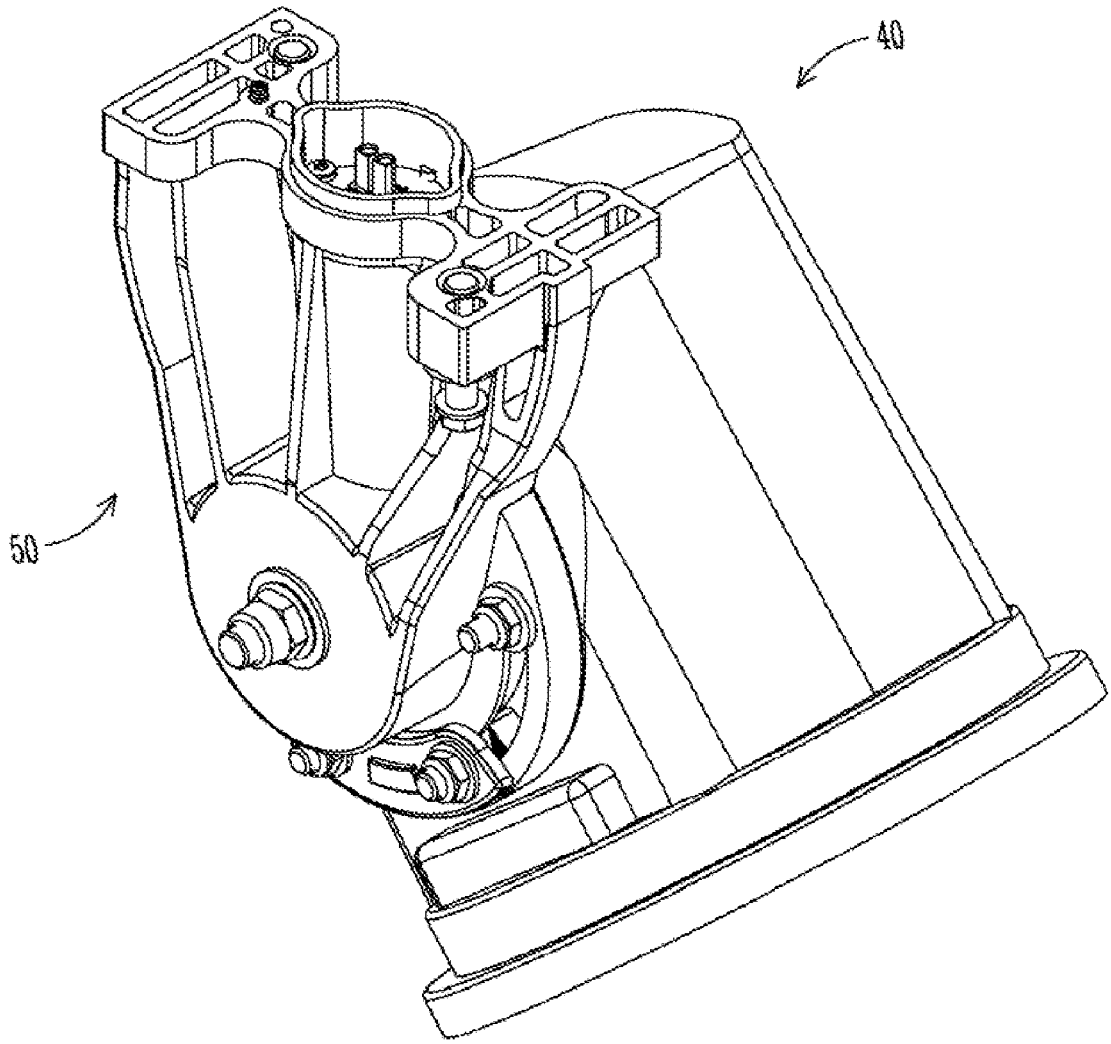
Fig. 5J1

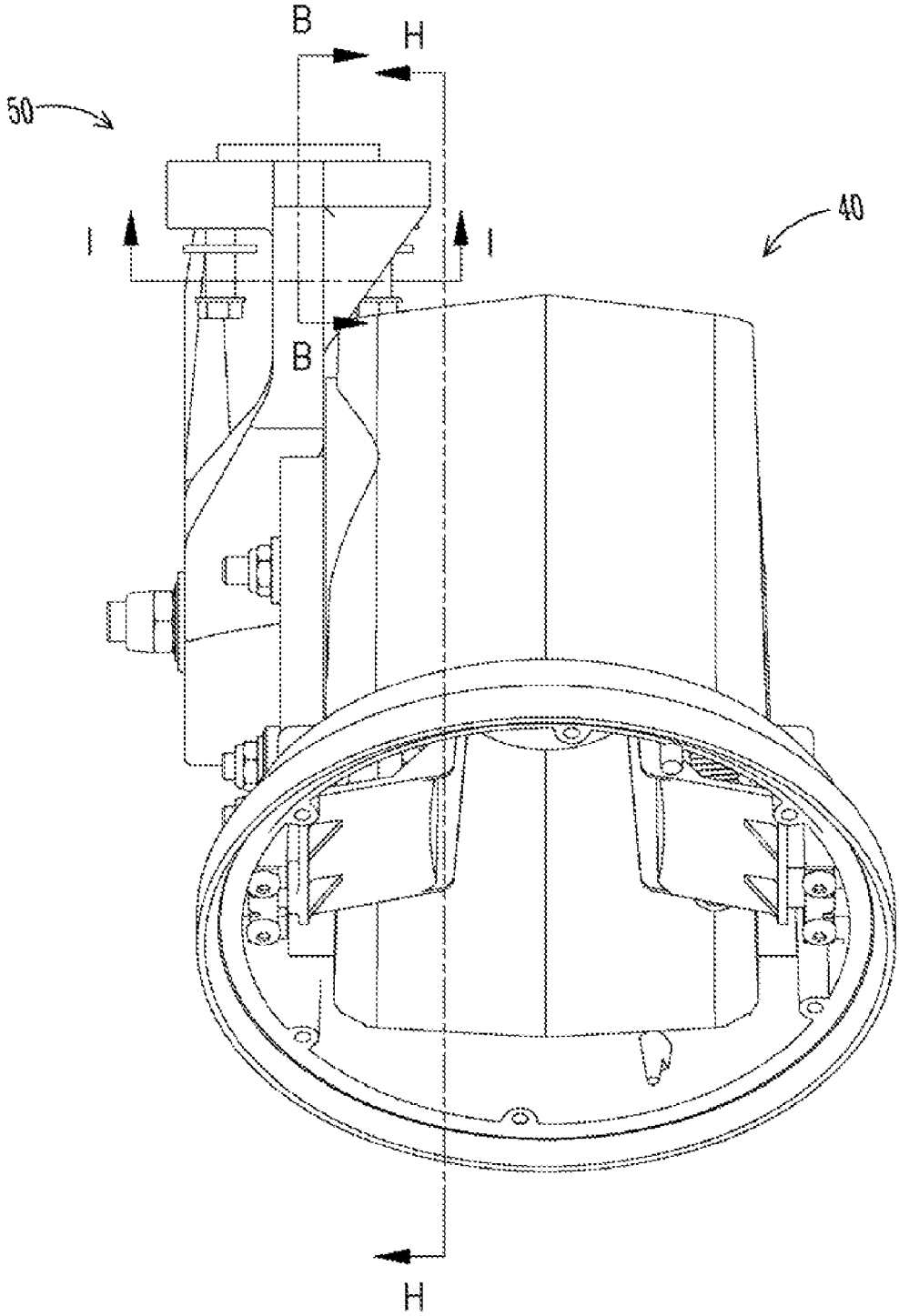
FRONT VIEW
Fig. 5J2

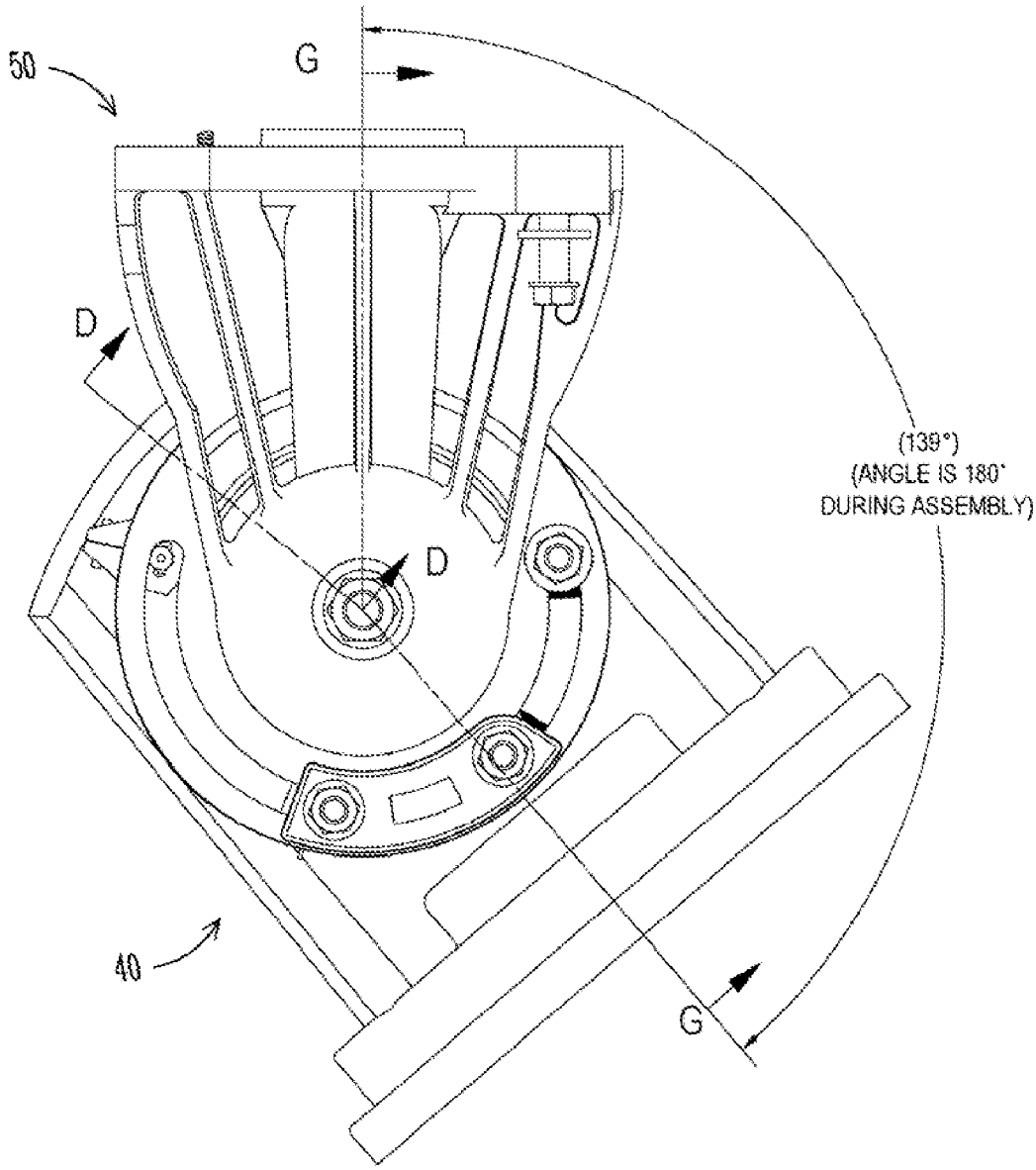
SIDE VIEW
Fig. 5J3

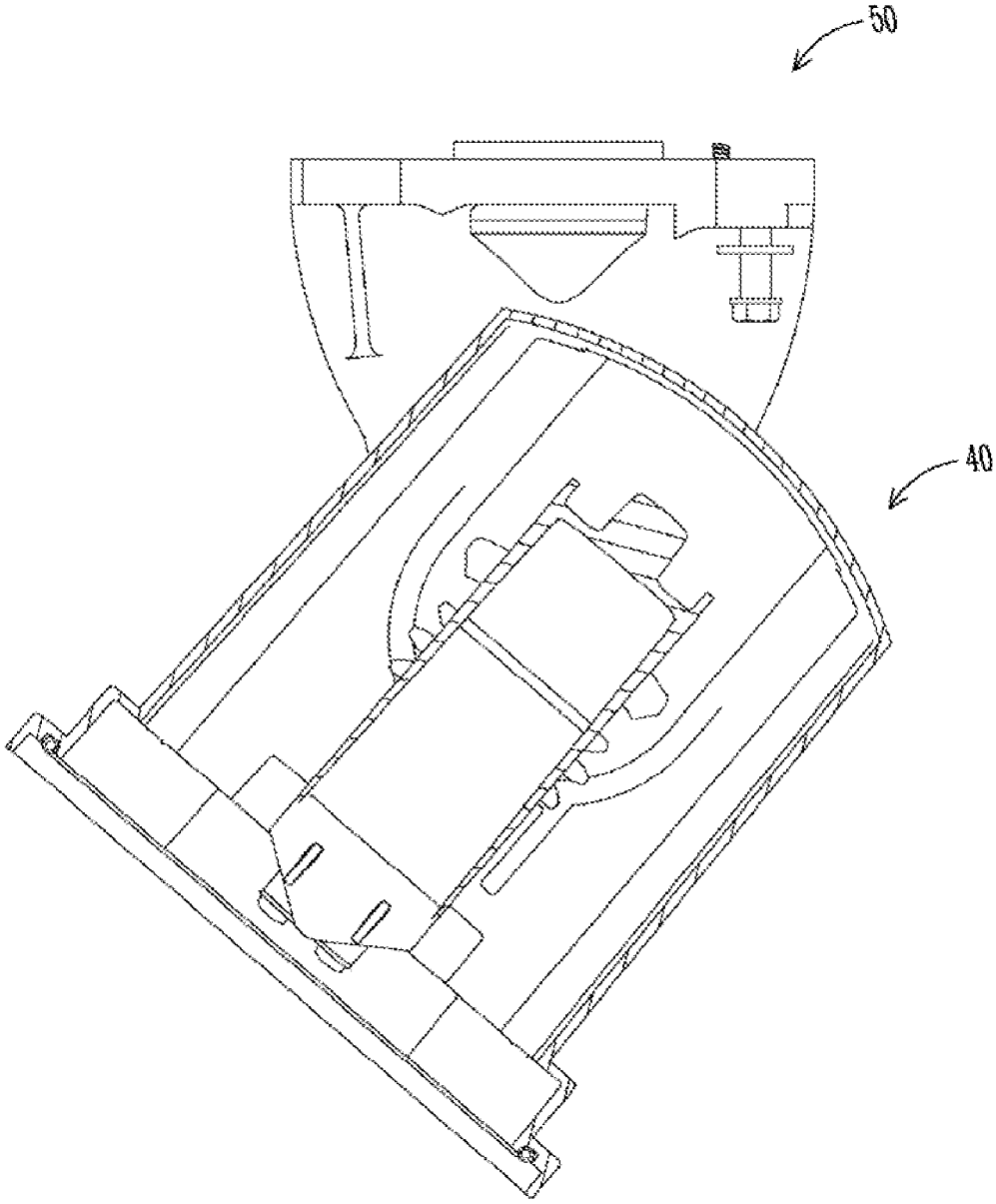
SECTION H-H
SHOWN AIMED AT 47° VERTICAL
*Fig. 5J4*

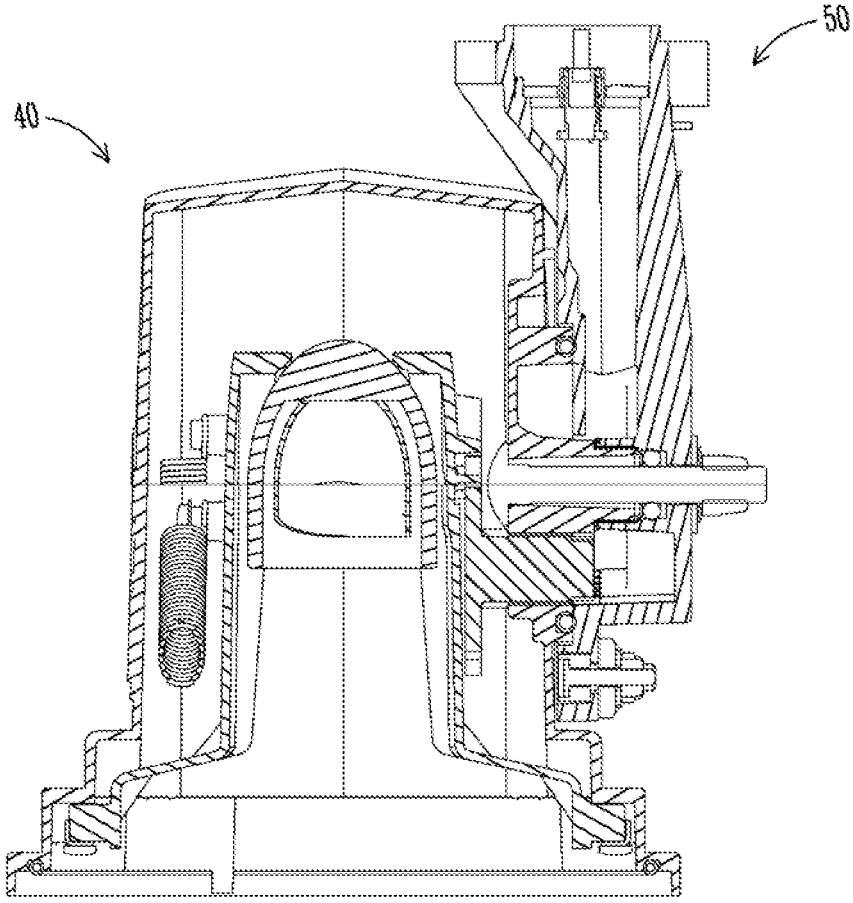
SECTION G-G
*Fig. 5J5*
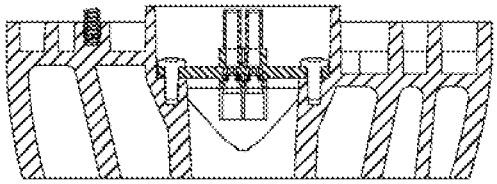
SECTION B-B
*Fig. 5J6*

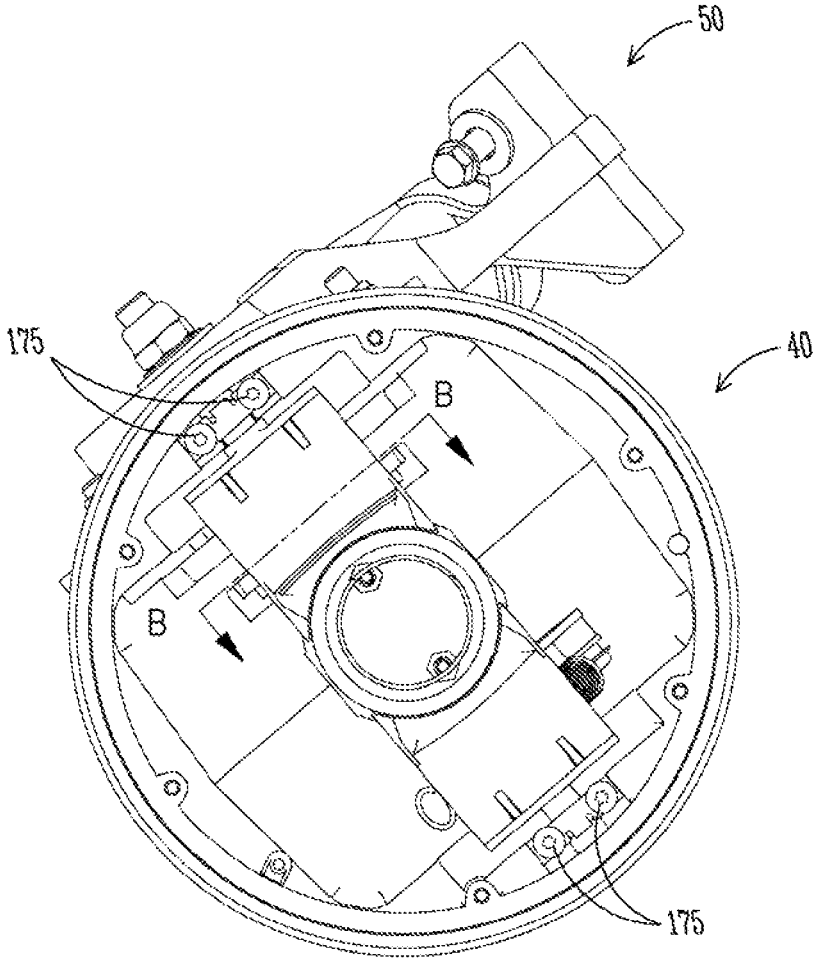
BOTTOM VIEW
*Fig. 5J7*
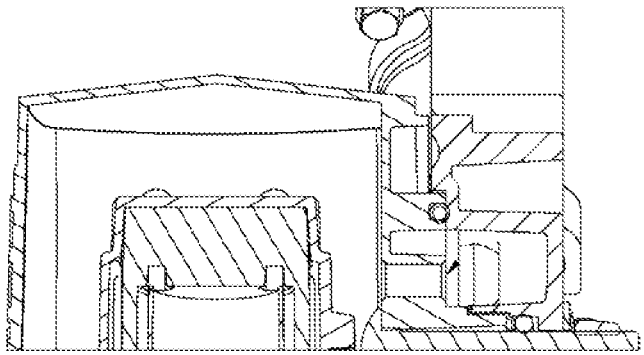
SECTION D-D
*Fig. 5J8*

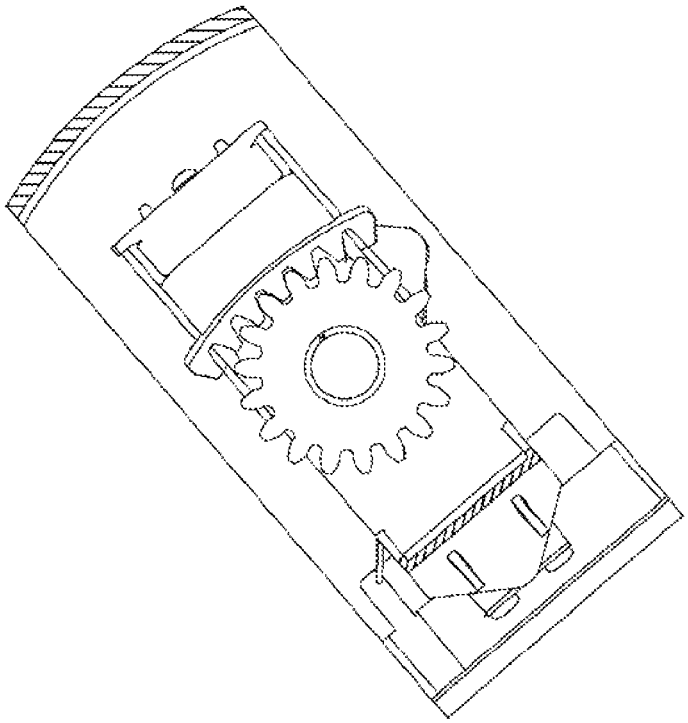
SECTION B-B
Fig.5J9
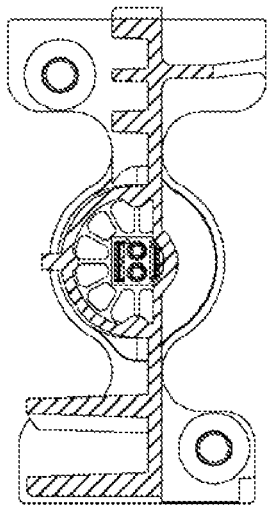
SECTION I-I
Fig.5J10

TOP VIEW

SIDE VIEW

BOTTOM VIEW

SECITON A-A

VIEW D-D

VIEW E-E

SECITON C-C

SECTION B-B

FRONT VIEW

SIDE VIEW

BACK VIEW

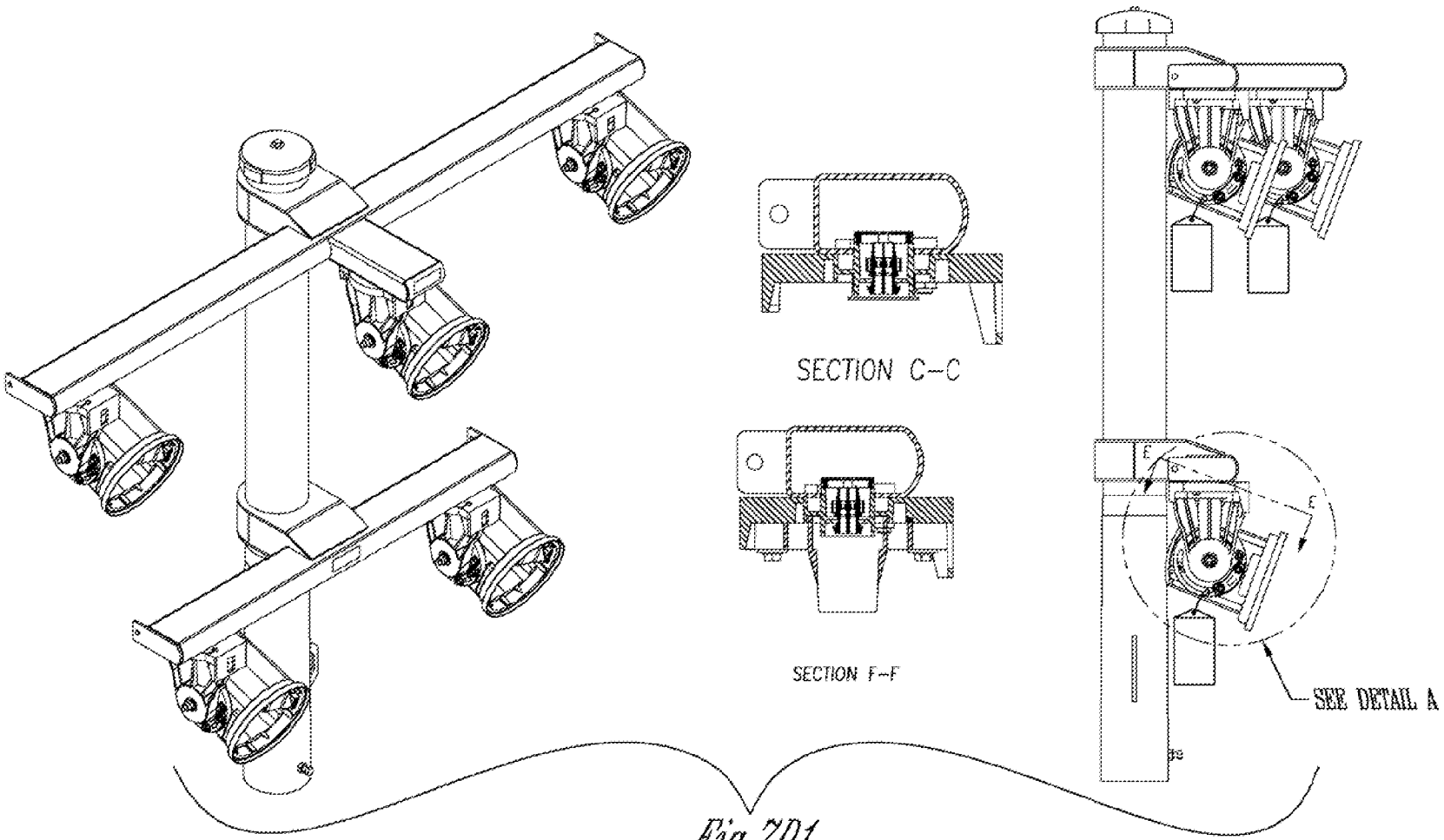
Fig. 7D1

Fig. 7D2
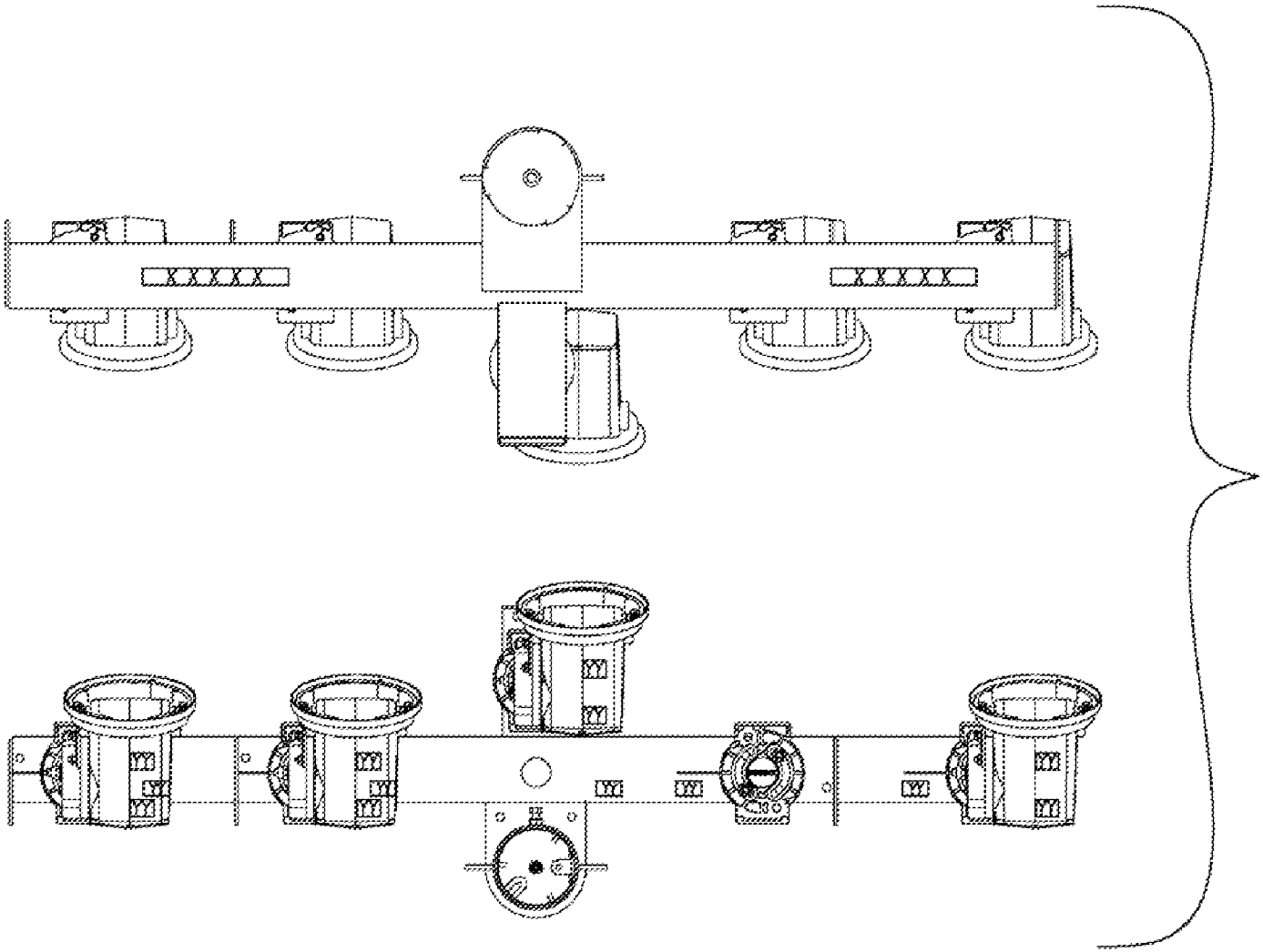

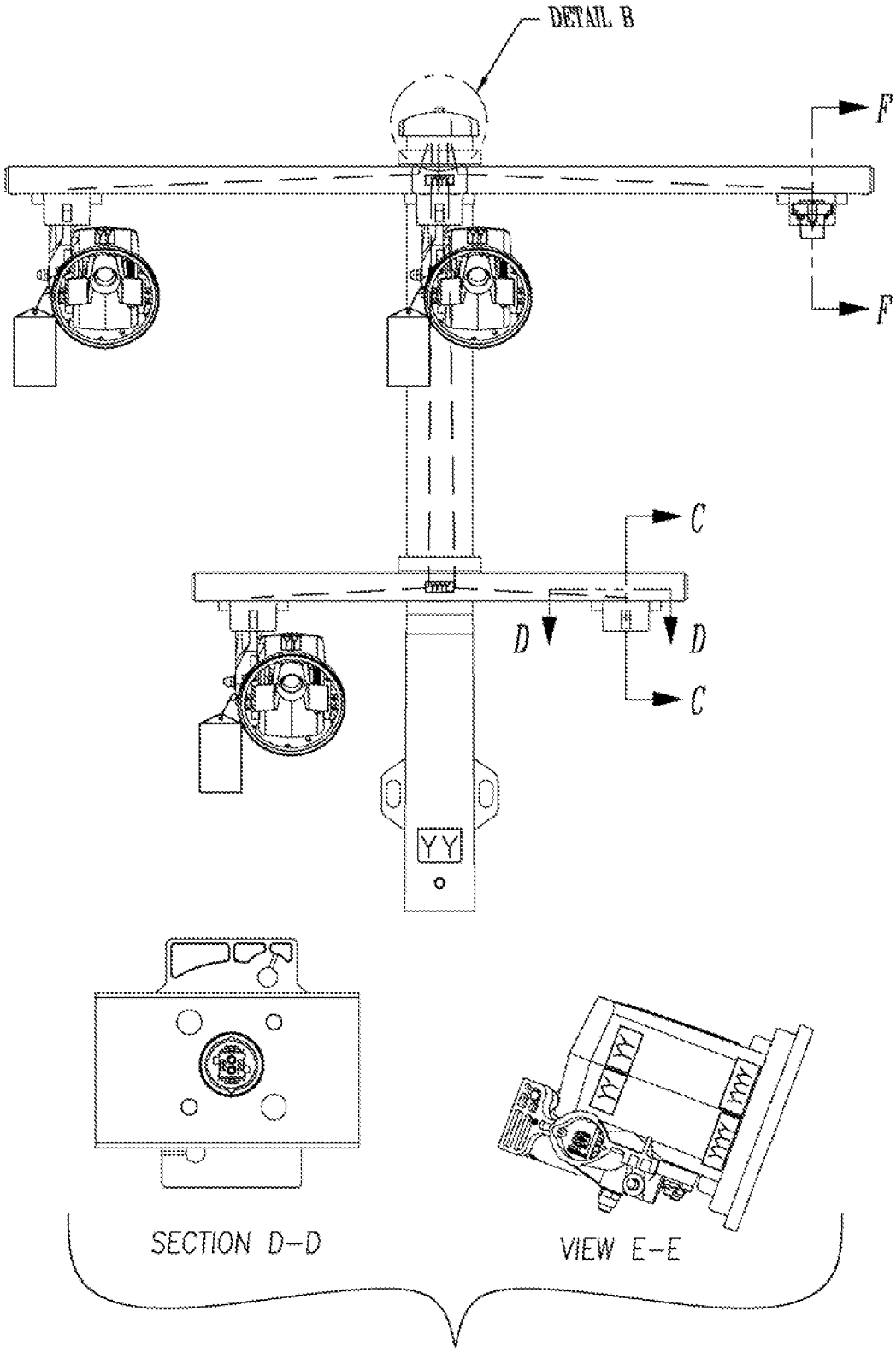
Fig. 7D3

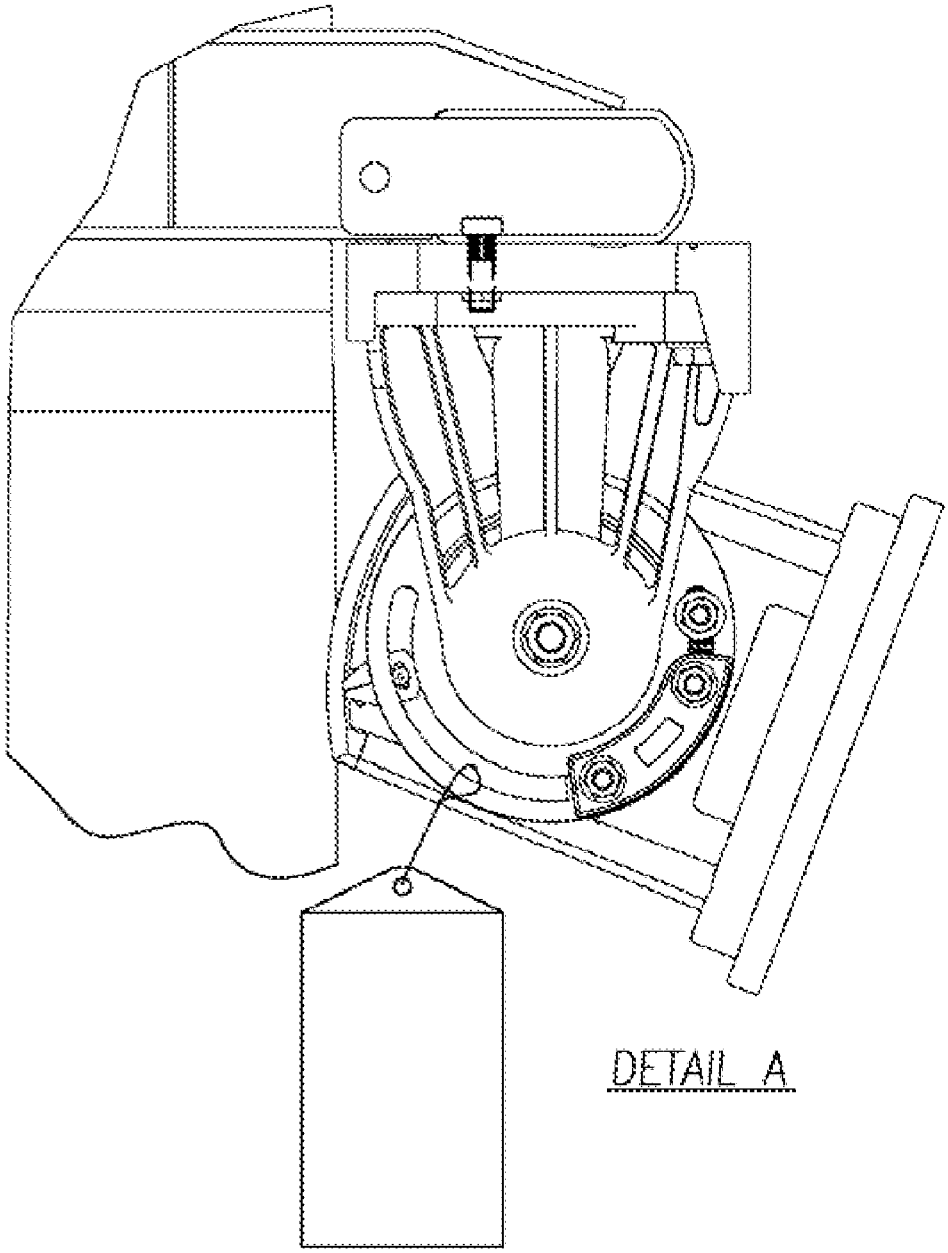
Fig. 7D4

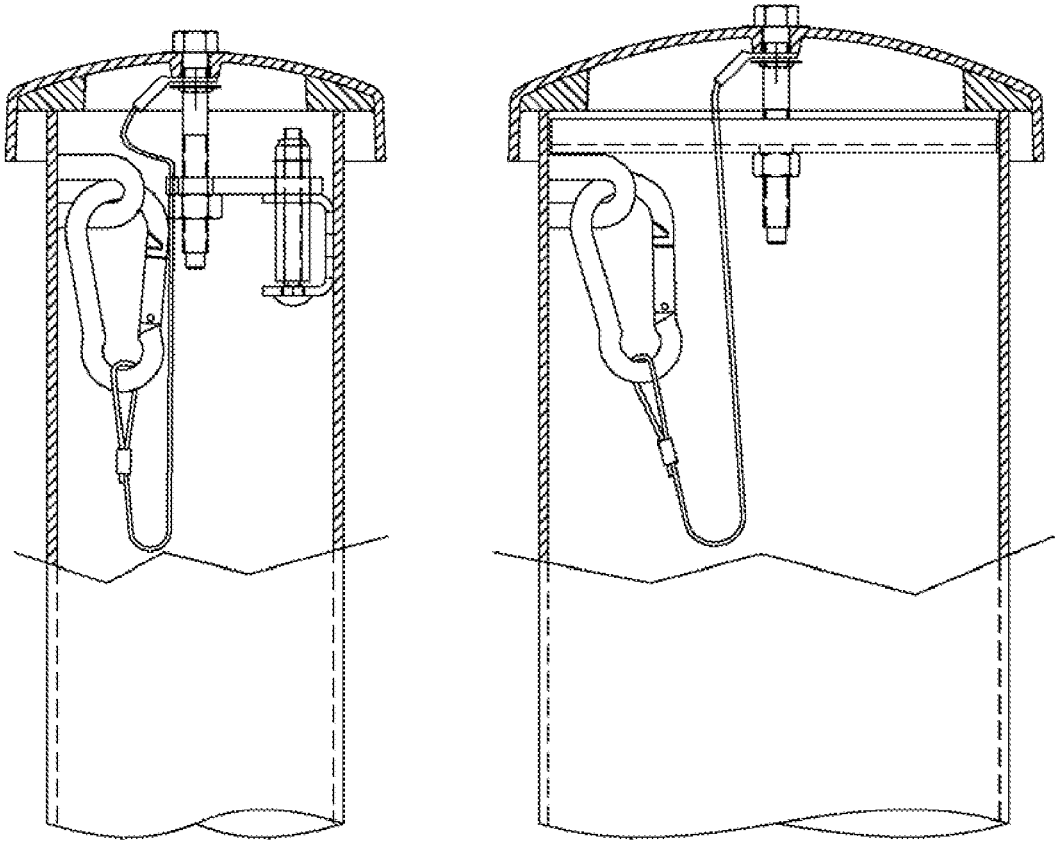
DETAIL B
Fig. 7D5

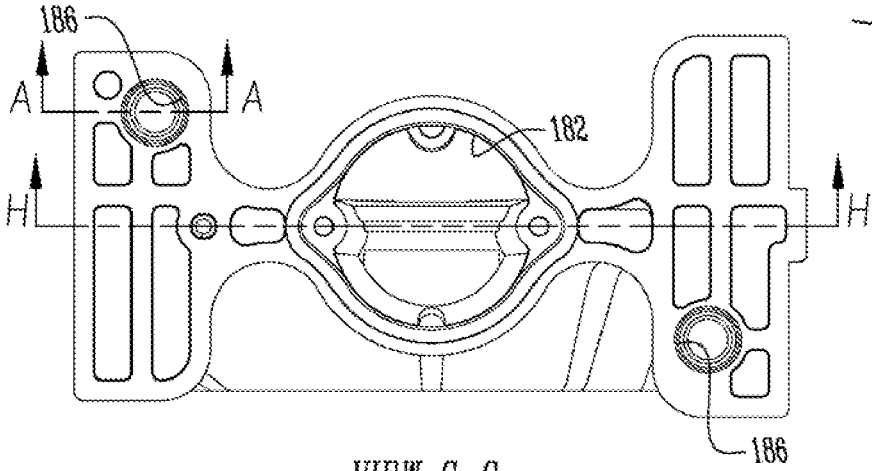
VIEW C-C
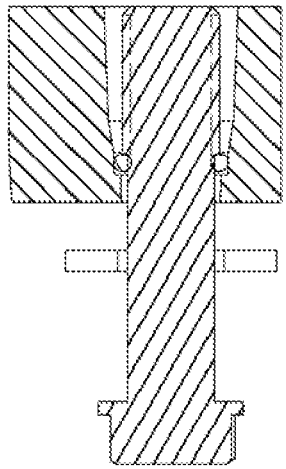
SECTION A-A
Fig. 7E
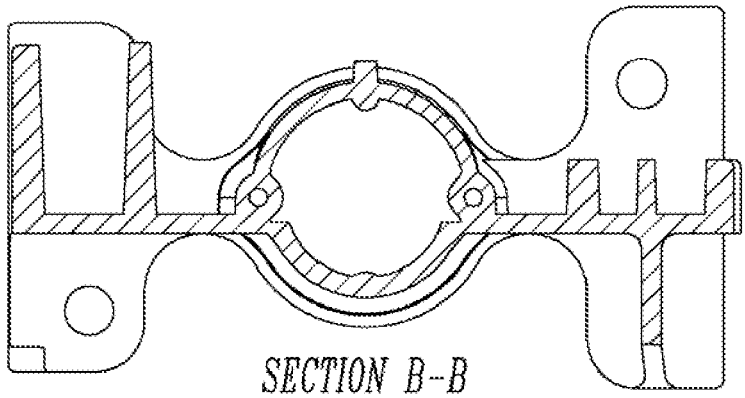
SECTION B-B
Fig. 7F

SECION H-H

SECTION I–I

SECTION J–J

DETAIL C

SIDE VIEW

FRONT VIEW

DETAIL A

FRONT VIEW

SIDE VIEW

SECTION A-A

DETAIL A

DETAIL A

FRONT VIEW

TOP VIEW

SECTION A-A

DETAIL A

DETAIL B

FRONT VIEW

SIDE VIEW

BACK VIEW

SECITON A-A

DETAIL A

SIDE VIEW

FRONT VIEW

LEFT SIDE VIEW

RIGHT SIDE VIEW

DETIAL A

BOTTOM VIEW

FRONT VIEW

SIDE VIEW

BOTTOM VIEW

GEARED TILT MECHANISM FOR ENSURING HORIZONTAL OPERATION OF ARC LAMP

CROSS REFERENCE TO RELATED APPLICATIONS

This application is a continuation application of U.S. Ser. No. 11/332,938 filed Jan. 17, 2006, which claims priority under 35 U.S.C. §119 of a provisional application U.S. Ser. No. 60/644,536 filed Jan. 18, 2005, all of which are incorporated by reference in their entirety. This application is also a non-provisional of the following provisional U.S. applications, all filed Jan. 18, 2005: U.S. Ser. No. 60/644,639; U.S. Ser. No. 60/644,747; U.S. Ser. No. 60/644,534; U.S. Ser. No. 60/644,720; U.S. Ser. No. 60/644,688; U.S. Ser. No. 60/644,636; U.S. Ser. No. 60/644,517; U.S. Ser. No. 60/644,609; U.S. Ser. No. 60/644,516; U.S. Ser. No. 60/644,546; U.S. Ser. No. 60/644,547; U.S. Ser. No. 60/644,638; U.S. Ser. No. 60/644,537; U.S. Ser. No. 60/644,637; U.S. Ser. No. 60/644,719; U.S. Ser. No. 60/644,784; U.S. Ser. No. 60/644,687, each of which is herein incorporated by reference in its entirety.

INCORPORATION BY REFERENCE

The contents of the following U.S. Patents are incorporated by reference by their entirety: Nos. 4,816,974; 4,947,303; 5,161,883; 5,600,537; 5,816,691; 5,856,721; 6,036,338.

BACKGROUND OF THE INVENTION

A. Field of the Invention

FIGS. 1A-F generally illustrate a sports field lighting system (see also the patents incorporated by reference). There is room for improvement with such fixtures and how they are operated.

B. Problems in the Art

The problem of light loss from tilt factor in certain HID lamps is well known. The present applicant has created and patented several ways to operate an arc tube in a glass envelope in a generally horizontal position. See certain of above-cited patents which are incorporated by reference herein.

There is still room for improvement in this area. Some solutions require structure that must be manually adjusted after the fixture is elevated. This is subject to error and is labor intensive. Some solutions fix the relationship of the arc tube relative the fixture. However, in most sports lighting systems the fixtures vary in angular orientation to the ground. In these cases, it is not possible to insure that all arc tubes for the system end up installed in a horizontal position.

SUMMARY OF THE INVENTION

The present invention relates to an apparatus and method for automatically keeping the arc tube of an HID lamp in a pre-determined orientation relative the fixture. It comprises a mechanism that maintains the arc tube in the same general orientation to the reflector of a light fixture regardless if the orientation of the reflector relative to the fixture is changed.

In one aspect a gearing arrangement between a yoke holding the lamp, a mounting elbow for the fixture, and the reflector, presents a new way of looking at sports lighting. The invention pertains to apparatus, methods, and systems to effectively and more energy-efficiently deliver light to the target space, and reduce glare and spill light outside the target space.

It is therefore a principal object, feature, or advantage of the present invention to present a high intensity lighting fixture, its method of use, and its incorporation into a lighting system, which improves over or solves certain problems and deficiencies in the art.

An apparatus according to one aspect or the invention comprises a high intensity lighting fixture apparatus with a yoke adapted to hold the arc lamp so that its arc tube operates in a horizontal position, or as close as possible thereto, over most conventional operating positions for the fixture.

In another aspect of the invention, an arc lamp with an arc tube offset from the longitudinal axis of the lamp envelope is used in combination with the yoke. The arc tube offset can be at an aiming angle within the typical range of aiming angles for sports lighting. The yoke and associated structure would keep the arc tube at or about horizontal automatically even though the reflector is moved anywhere in that typical range.

These and other objects, features, advantages and aspects of the present invention will become more apparent with reference to the accompanying specification and claims.

BRIEF DESCRIPTION OF THE DRAWINGS

FIGS. 1A-G generally illustrate a sports field lighting system (see also the patents incorporated by reference). There is room for improvement with such fixtures and how they are operated.

FIGS. 5A-J are various views of a bulb cone into which an HID lamp can be removably mounted and to which a reflector can be mounted.

FIGS. 7A-J are various views of an elbow connectable to the elbow mount of FIG. 6A and to the cone of FIG. 5A.

FIGS. 14A-I are various views of a yoke into which the HID lamp is mounted which can pivot angularly relative to the cone.

DETAILED DESCRIPTION OF EXEMPLARY EMBODIMENTS

A. Exemplary Apparatus

1. Lighting Fixture 10 Generally

Figure 3:
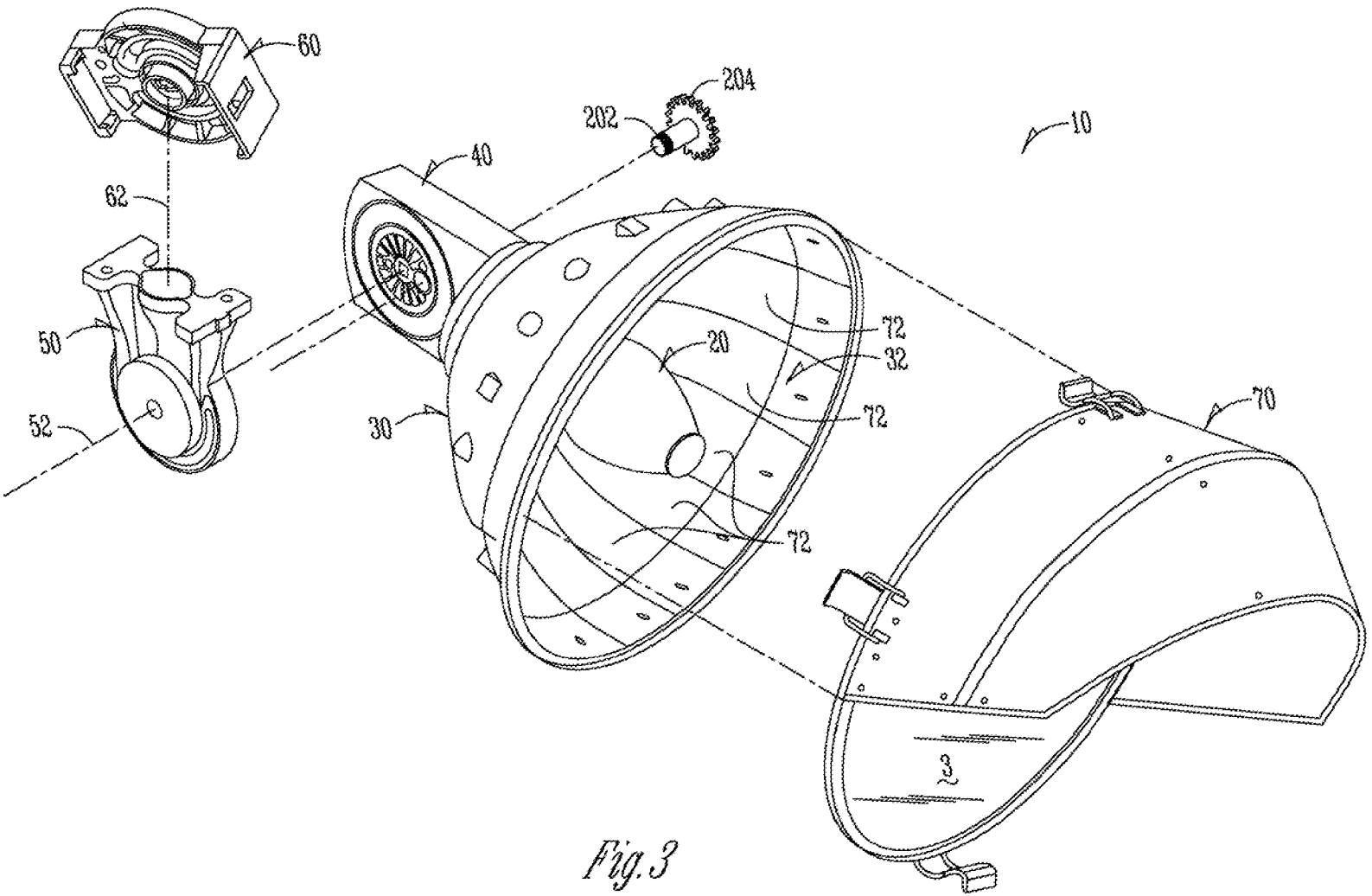
FIG. 3 is a diagrammatic, partial exploded view of a light fixture 10 according to an exemplary embodiment of the present invention.
Figure 4A:
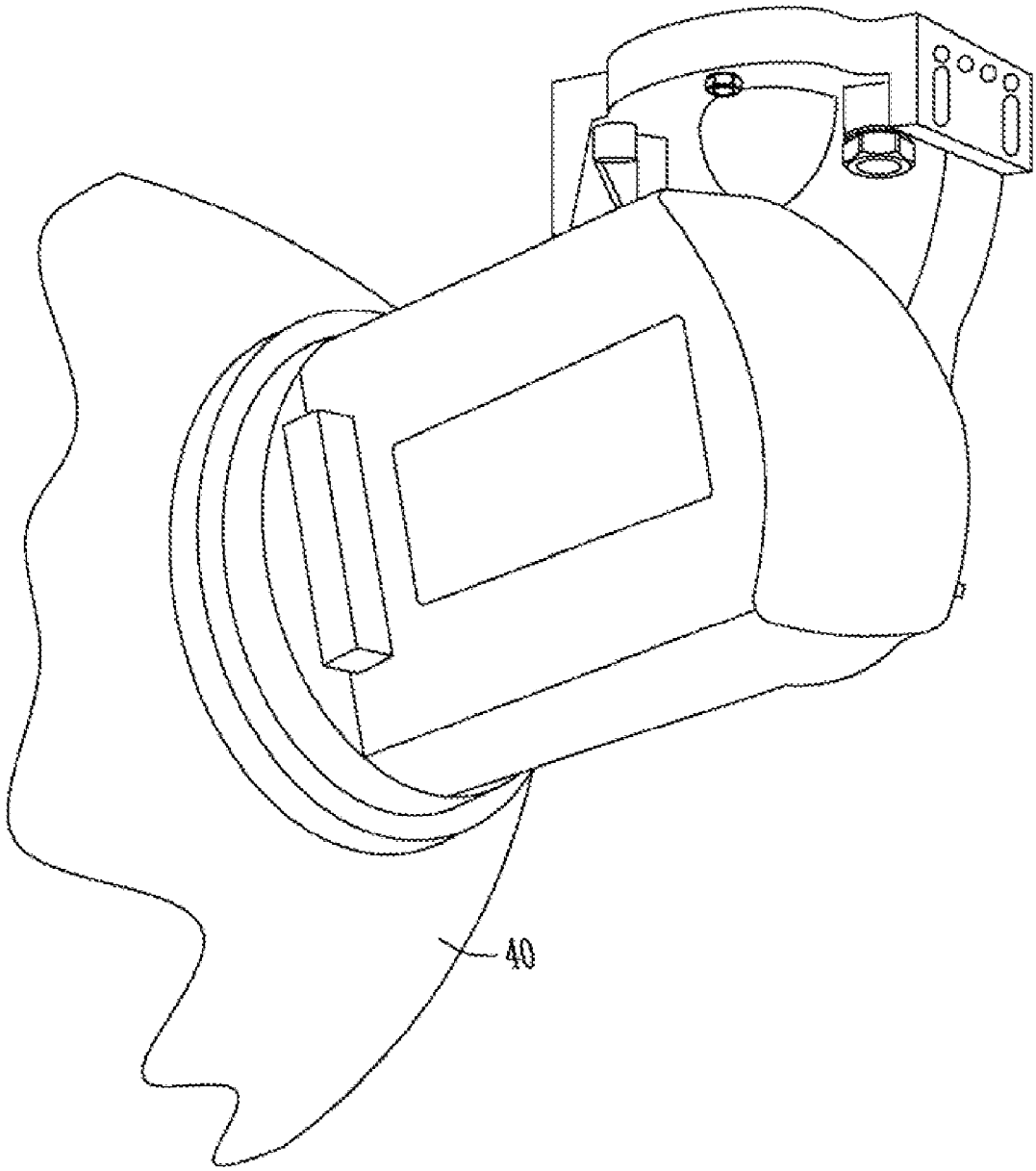
FIGS. 4A-D is a diagrammatic illustration of operation of an automatic tilt factor correction mechanism according to an exemplary embodiment of the invention.
Figure 4B:
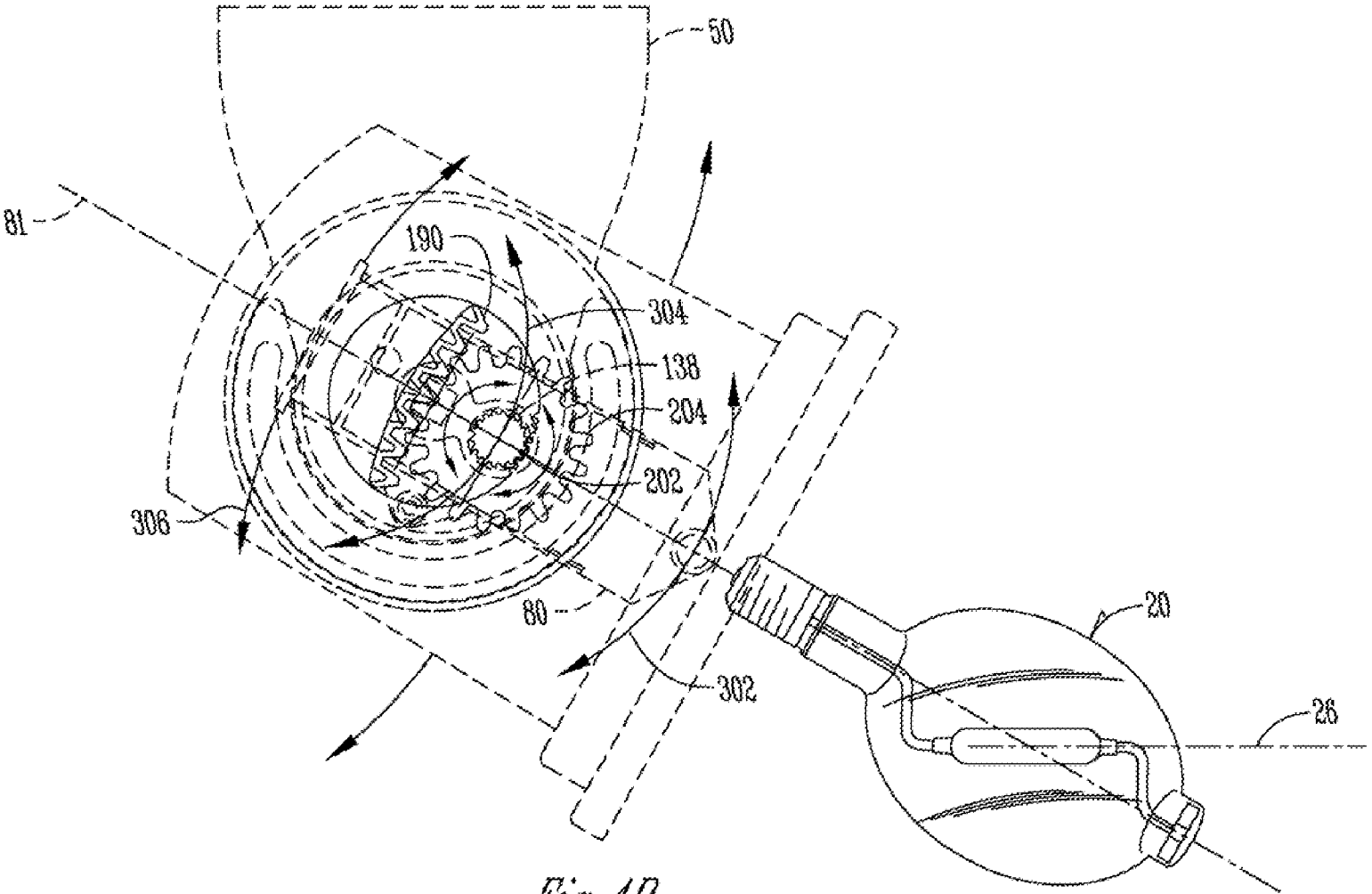
Figure 4C:
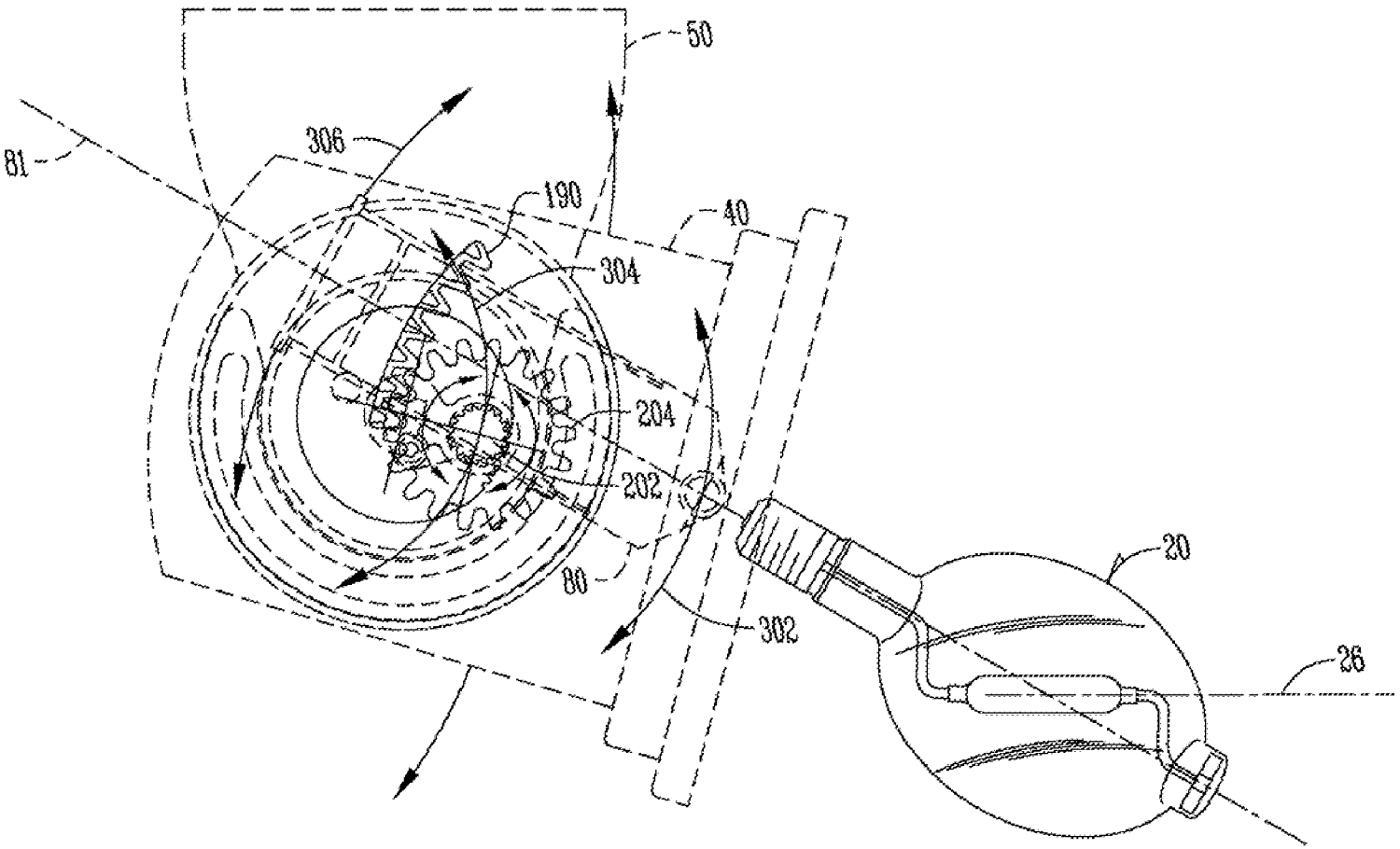
Figure 4D:
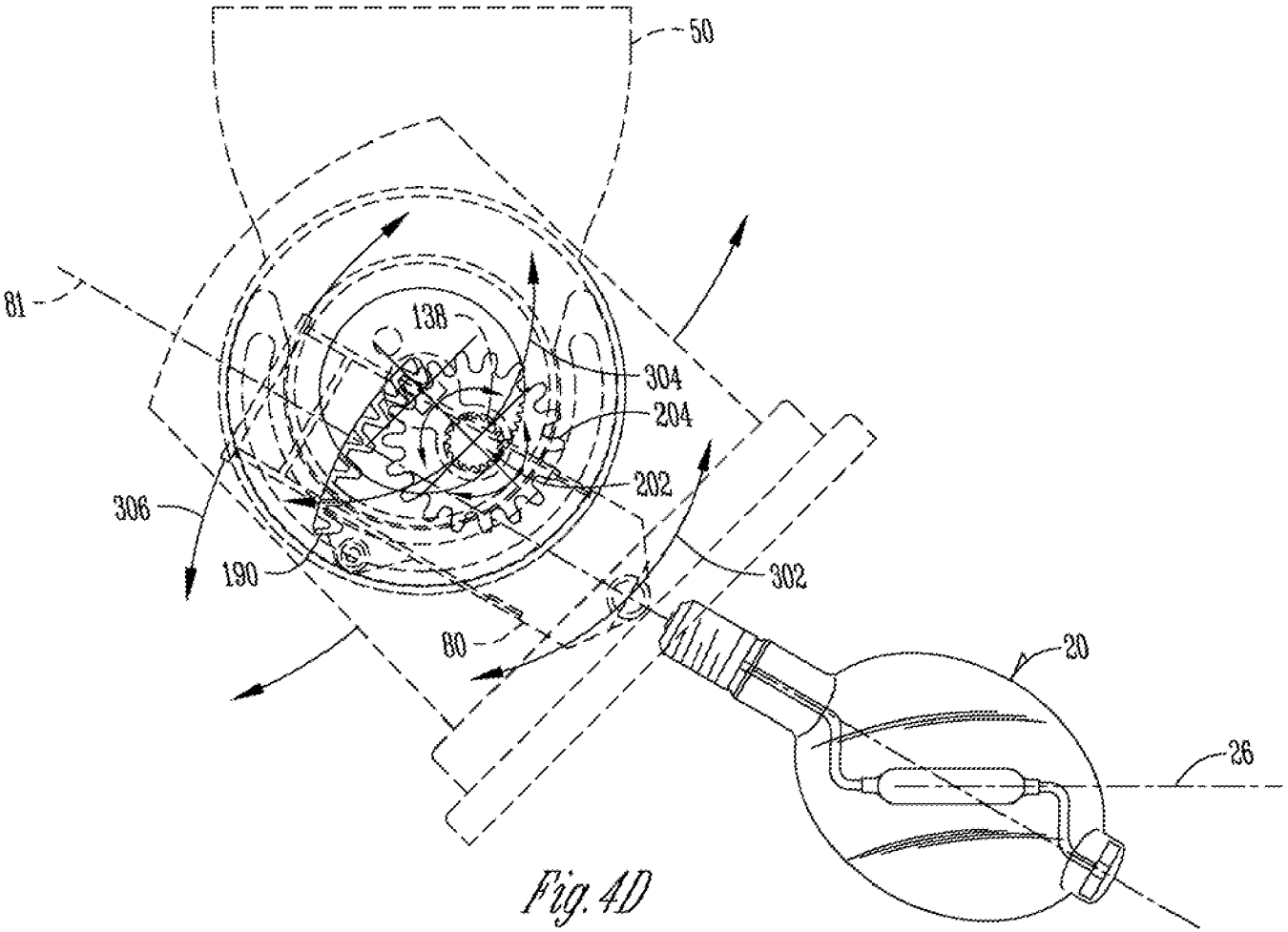

FIG. 3 shows the basic components of sports lighting fixture 10 in exploded form.

Figure 1A:
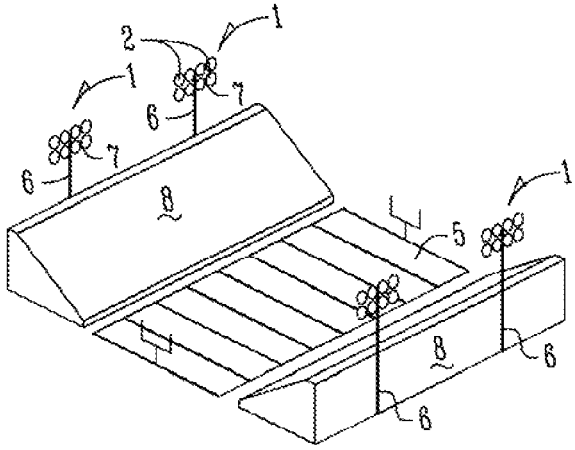
Figure 1B:
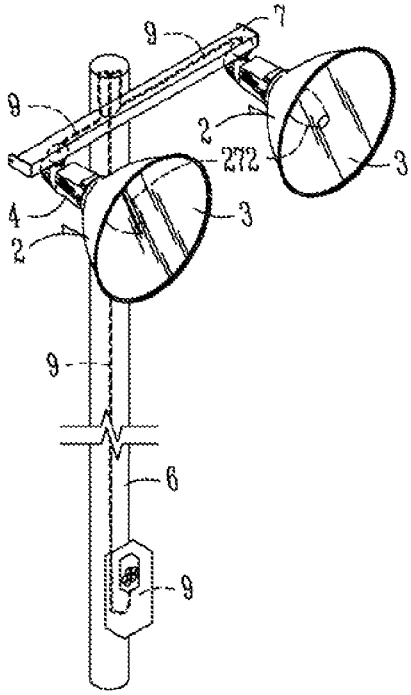
Figure 1C:
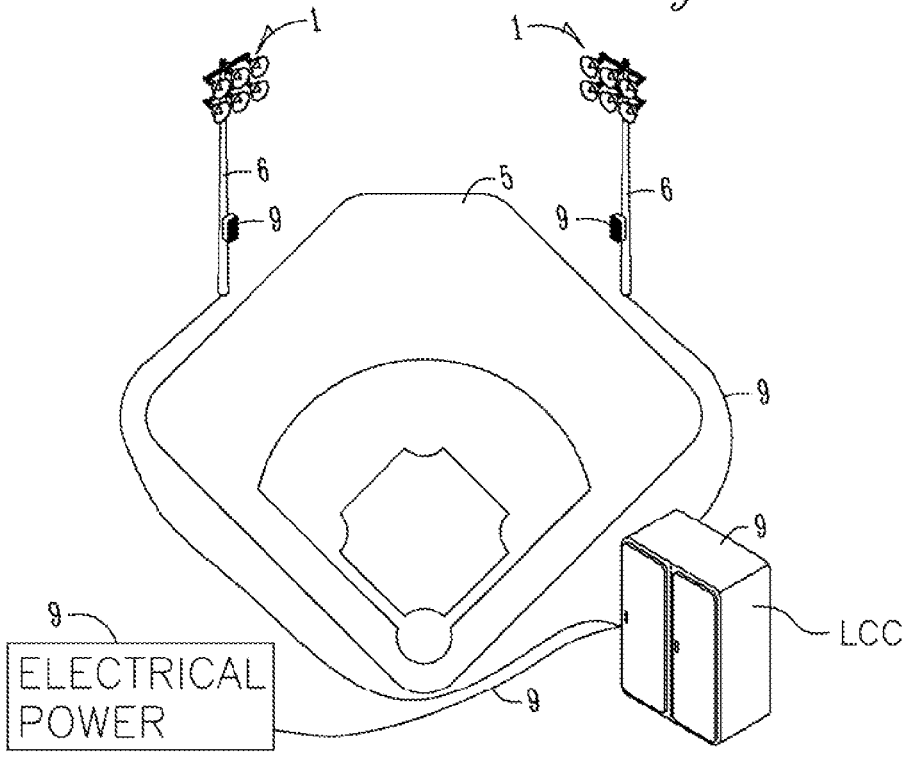
Figure 1D:
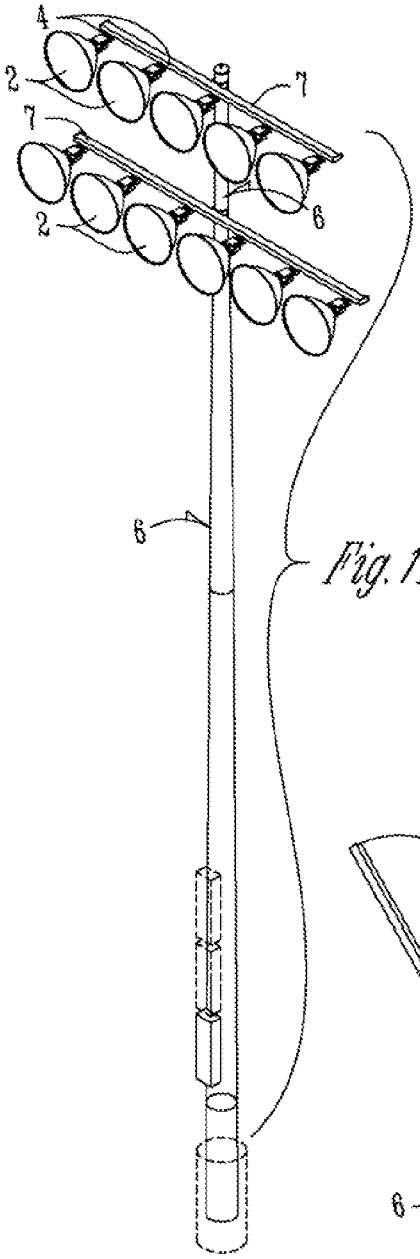
Figure 1C:
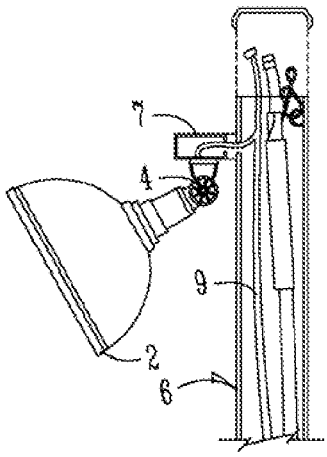
Figure 1E:
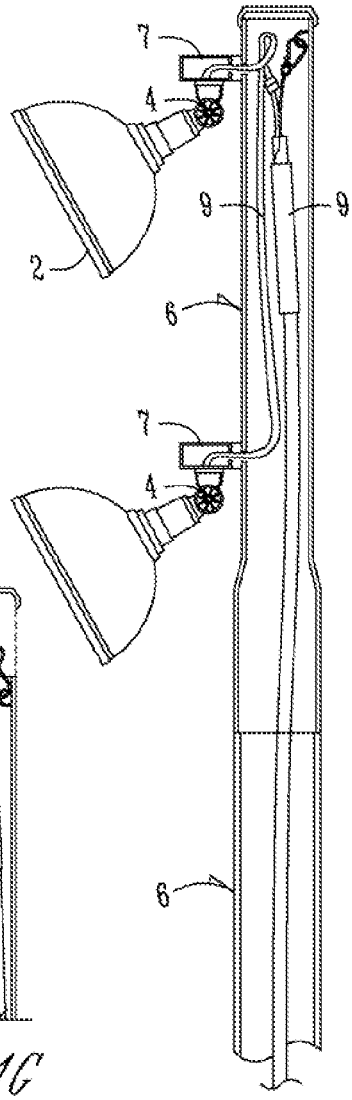
Figure 1F:
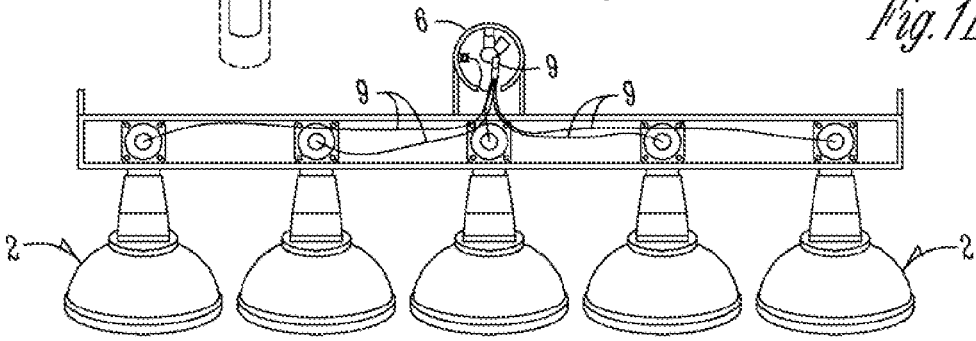
Figure 2A:
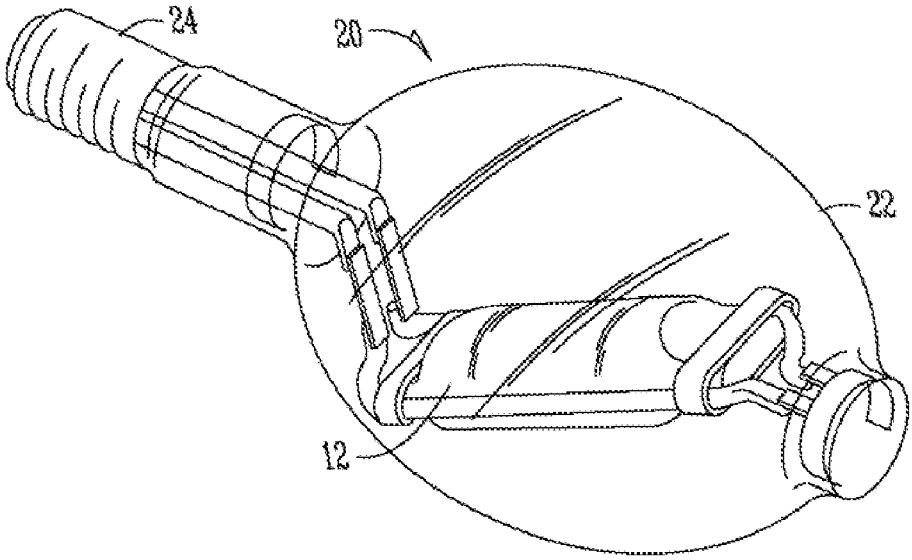
FIGS. 2A-C illustrate a high intensity discharge arc lamp that is used with an exemplary embodiment of the present invention.
Figure 2B:
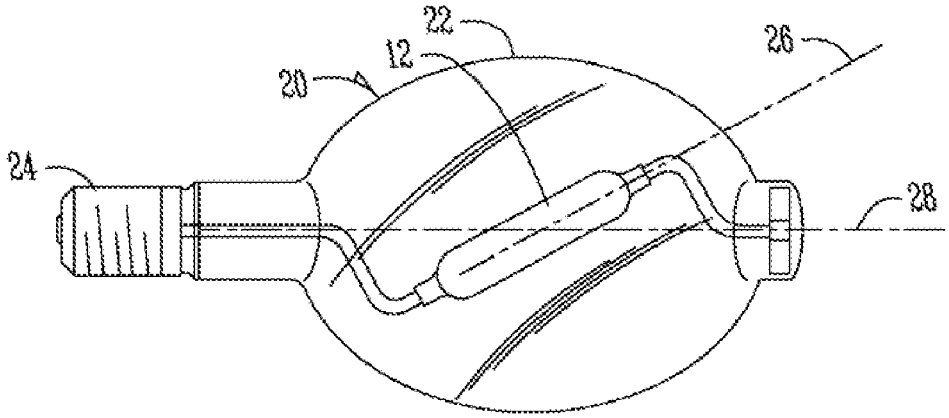
Figure 2C:
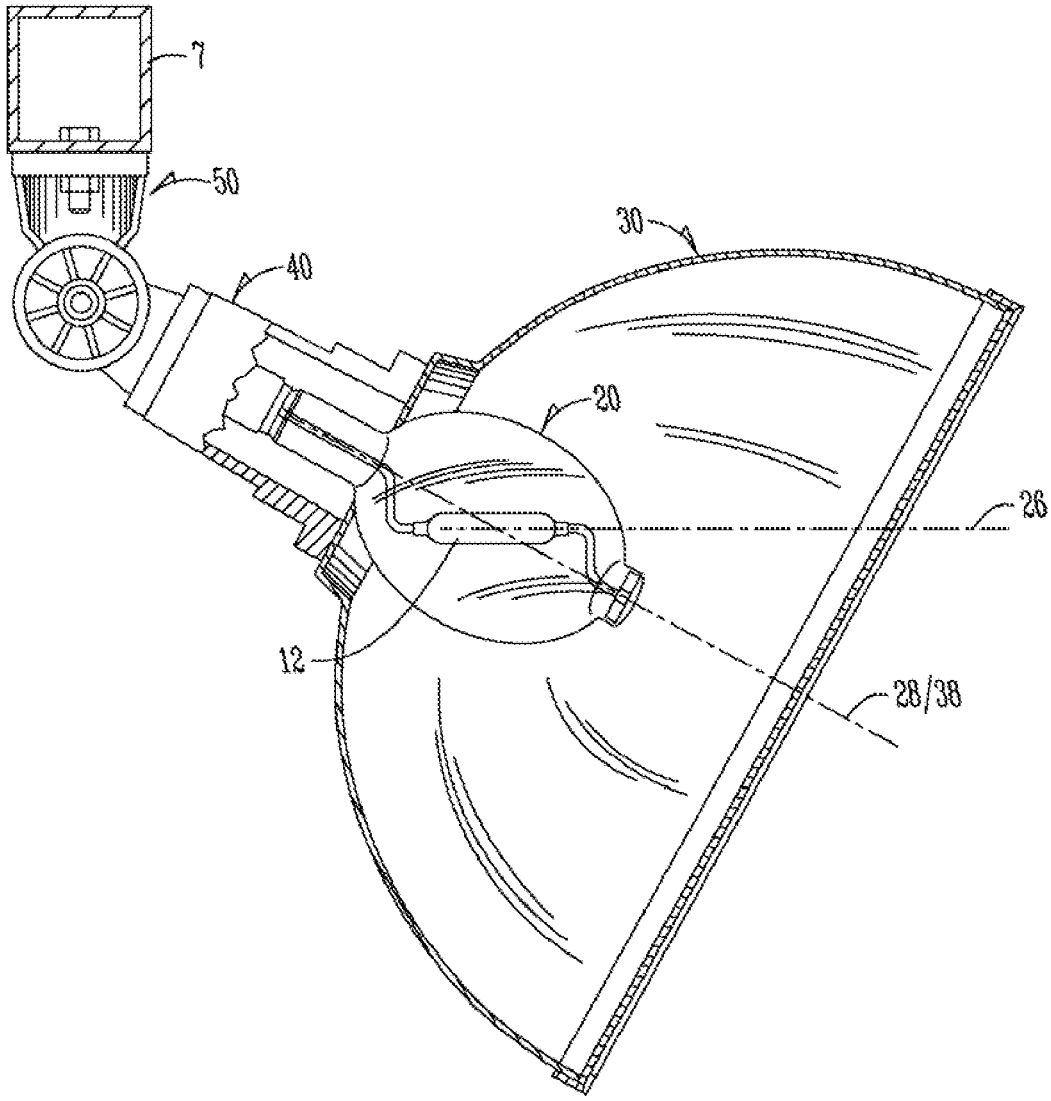
Figure 14A:
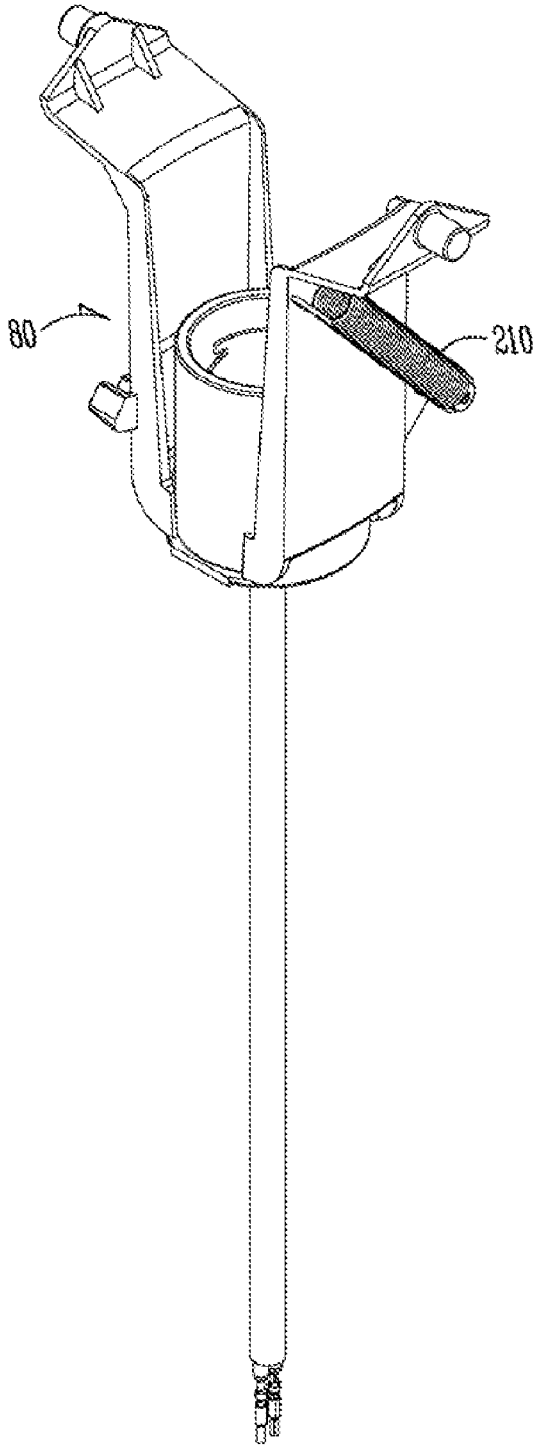
Figure 14B:
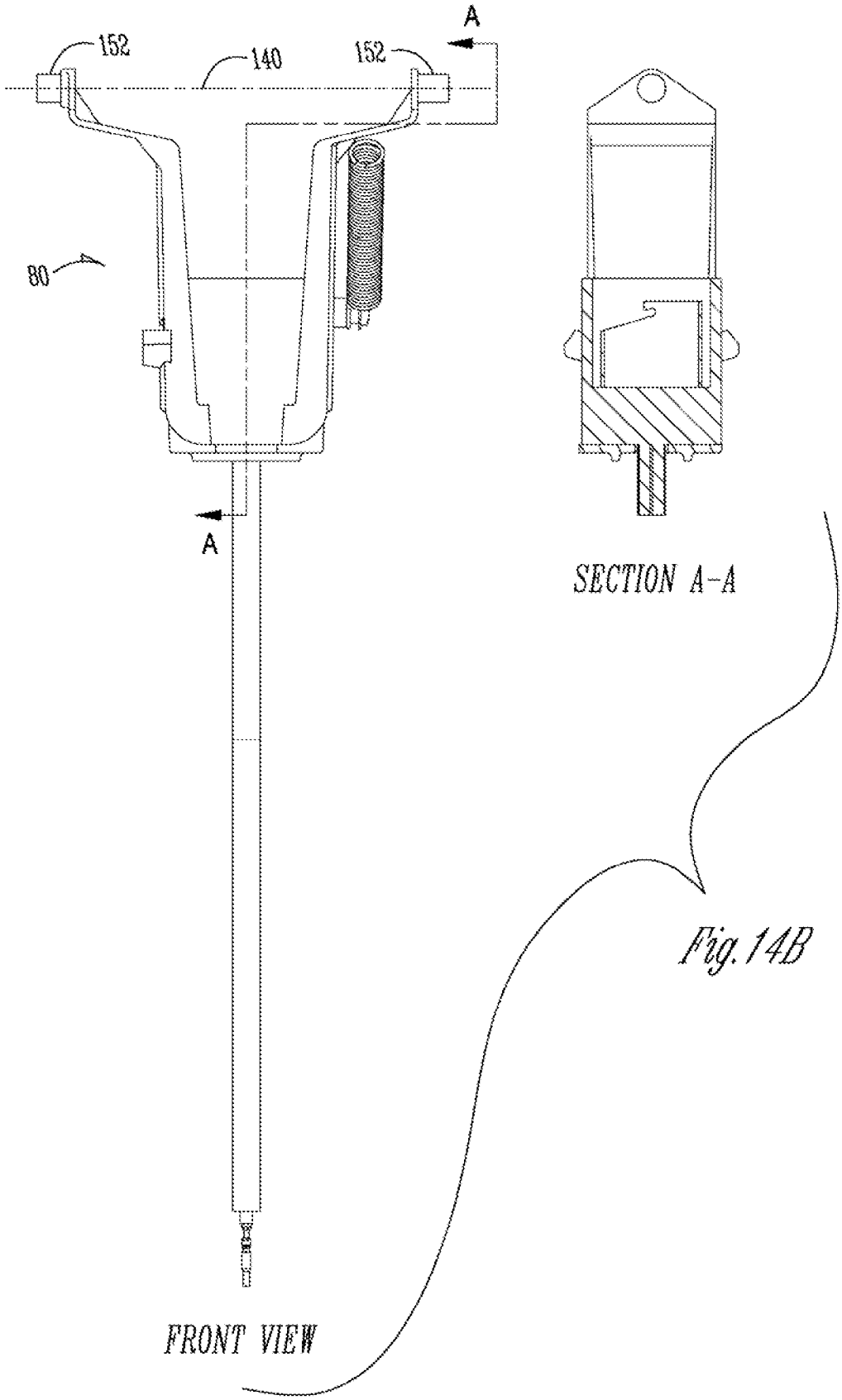
Figure 14C:
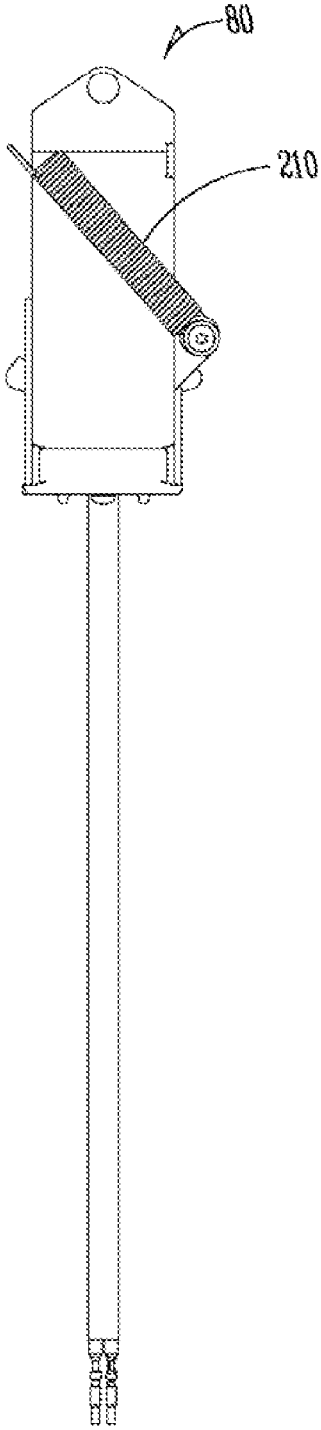

Lamp cone 40 (360 Aluminum with polyester powder coat) pivots around axis 52 relative to knuckle 50, which pivots around axis 62 relative to knuckle plate 60 which is fixed to cross arm 7 (see FIGS. 3 and 7D4); alternatively, knuckle 50 may be fixed to cross arm 7 directly (see FIG. 2C). Lamp cone 40 contains a socket 154 (shown diagrammatically in FIG. 14A, commercially available) which is bolted to flat web 160 between arms 156 and 158 of yoke 80 (see FIG. 14A). Lamp 20 (Musco Corporation LAMP™ brand lamp) has a threaded base 24 that can be screwed in and out of socket 154 (shown screwed into operating position in FIG. 3) to install or remove lamp 20 from fixture 10 which may further comprise a reflector frame 30 (which may house individual reflector components 72), a visor system 70, and a lens 3.

2. Lamp 20

Arc lamp 20 is of the general type disclosed in Musco Corporation U.S. Pat. No. 5,856,721, incorporated by reference herein, with certain modifications. These types of lamps are used by Musco Corporation under the trademark Z-LAMP™ brand lamp and typically are 1000 watt or greater metal halide (MH) HID lamps. Its arc tube 12, housed in lamp envelope 22, is tilted obliquely along axis 26 across longitudinal axis 28 of arc lamp 20. In operation, arc tube 12 is rotationally positioned in fixture 10 such that the longitudinal axis of arc tube 12 is as close to a horizontal plane as possible.

3. Yoke 80

Figure 5A:
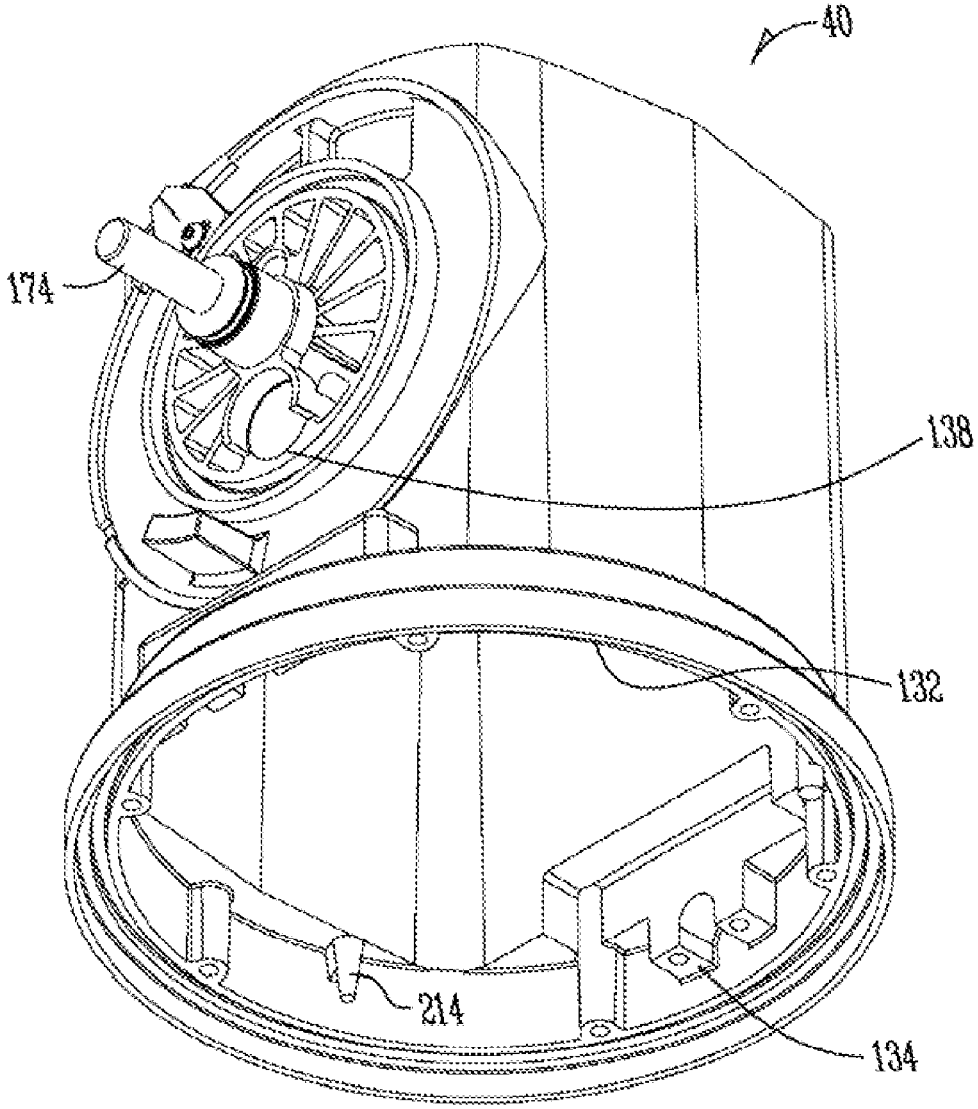
Figure 5B:
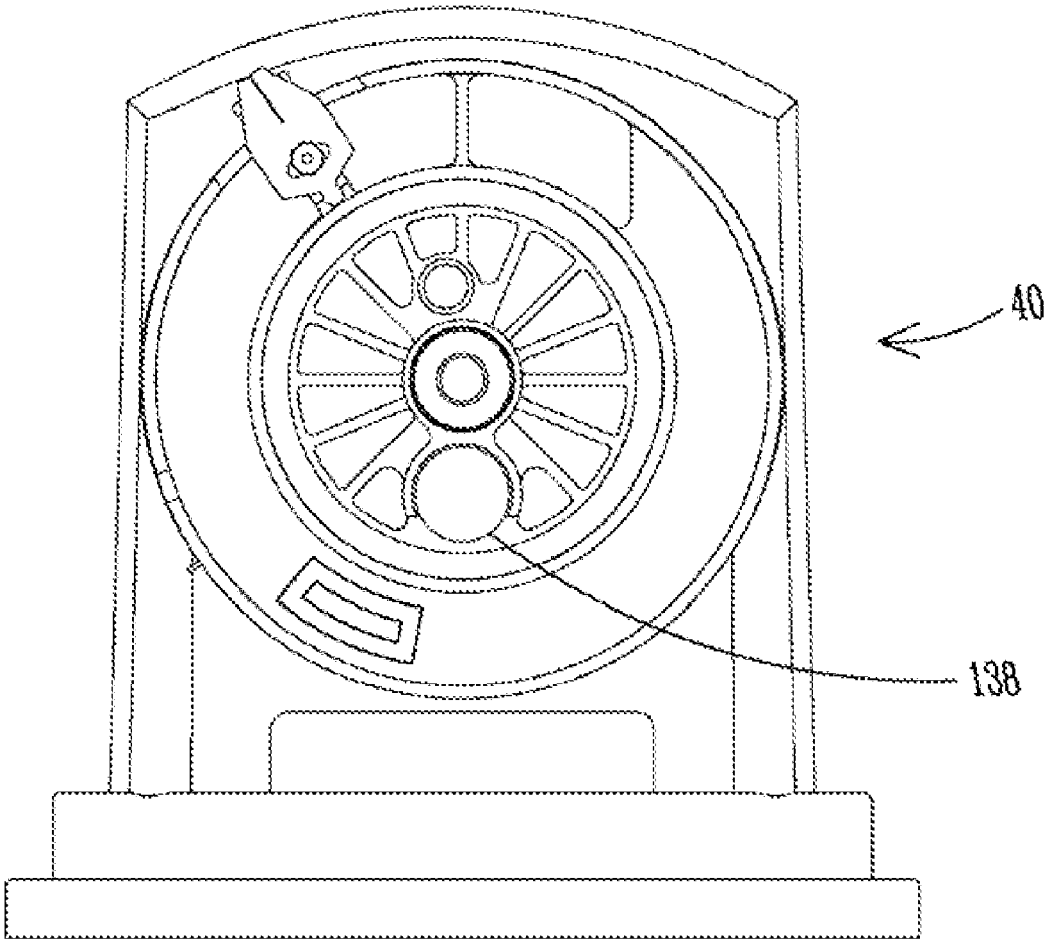
Figure 5C:
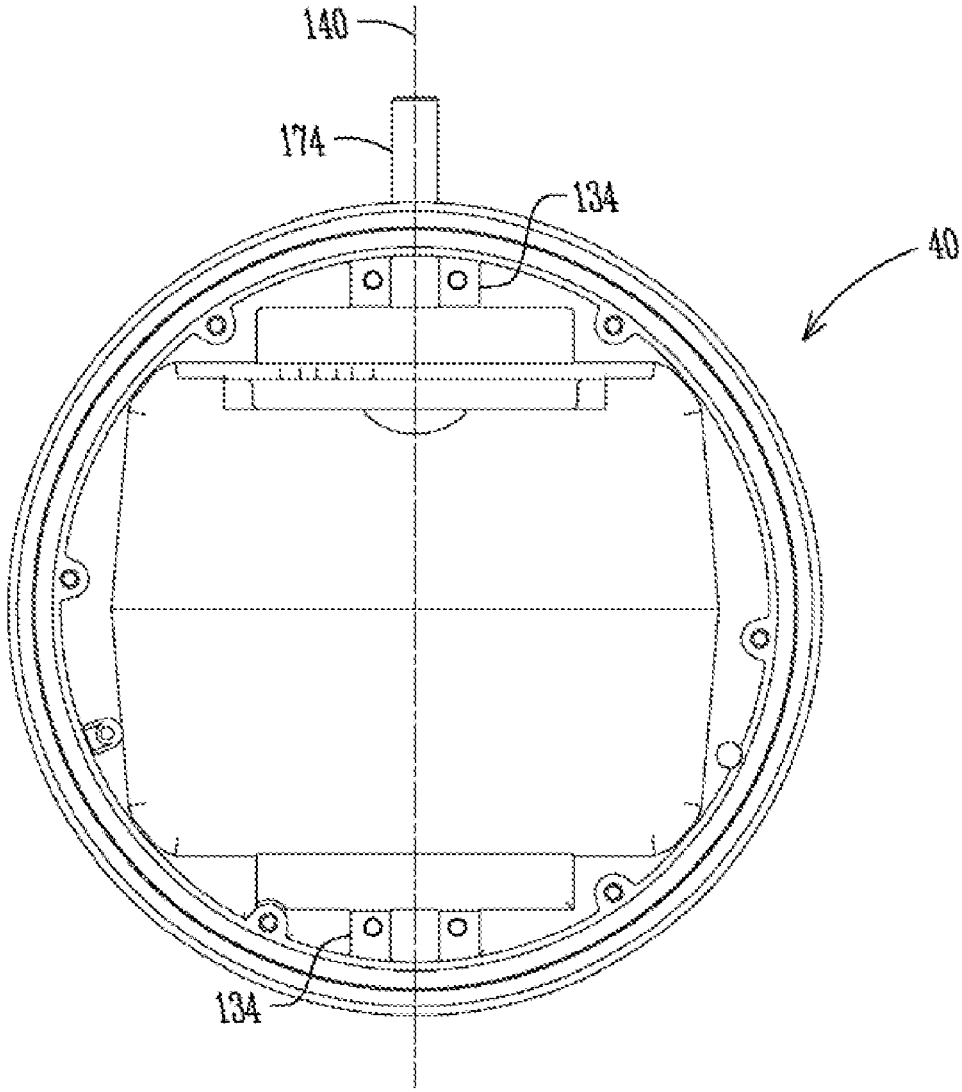
Figure 5D:
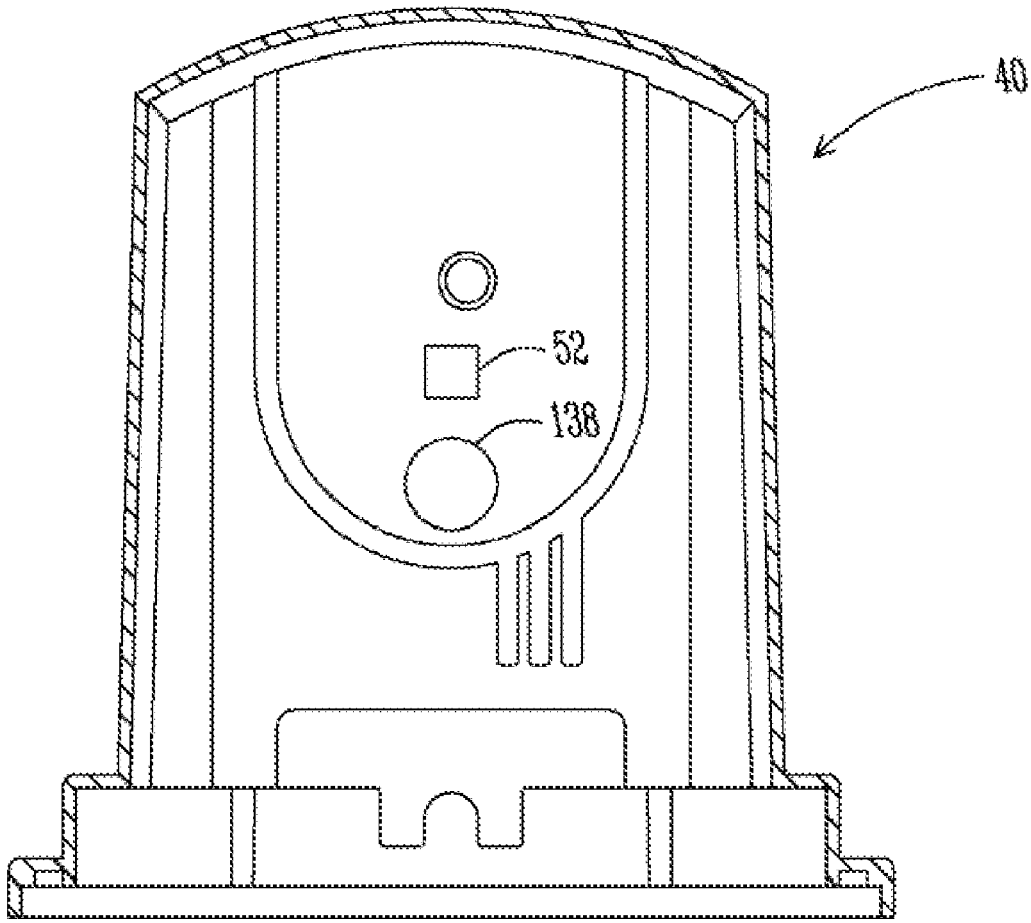
Figure 5E:
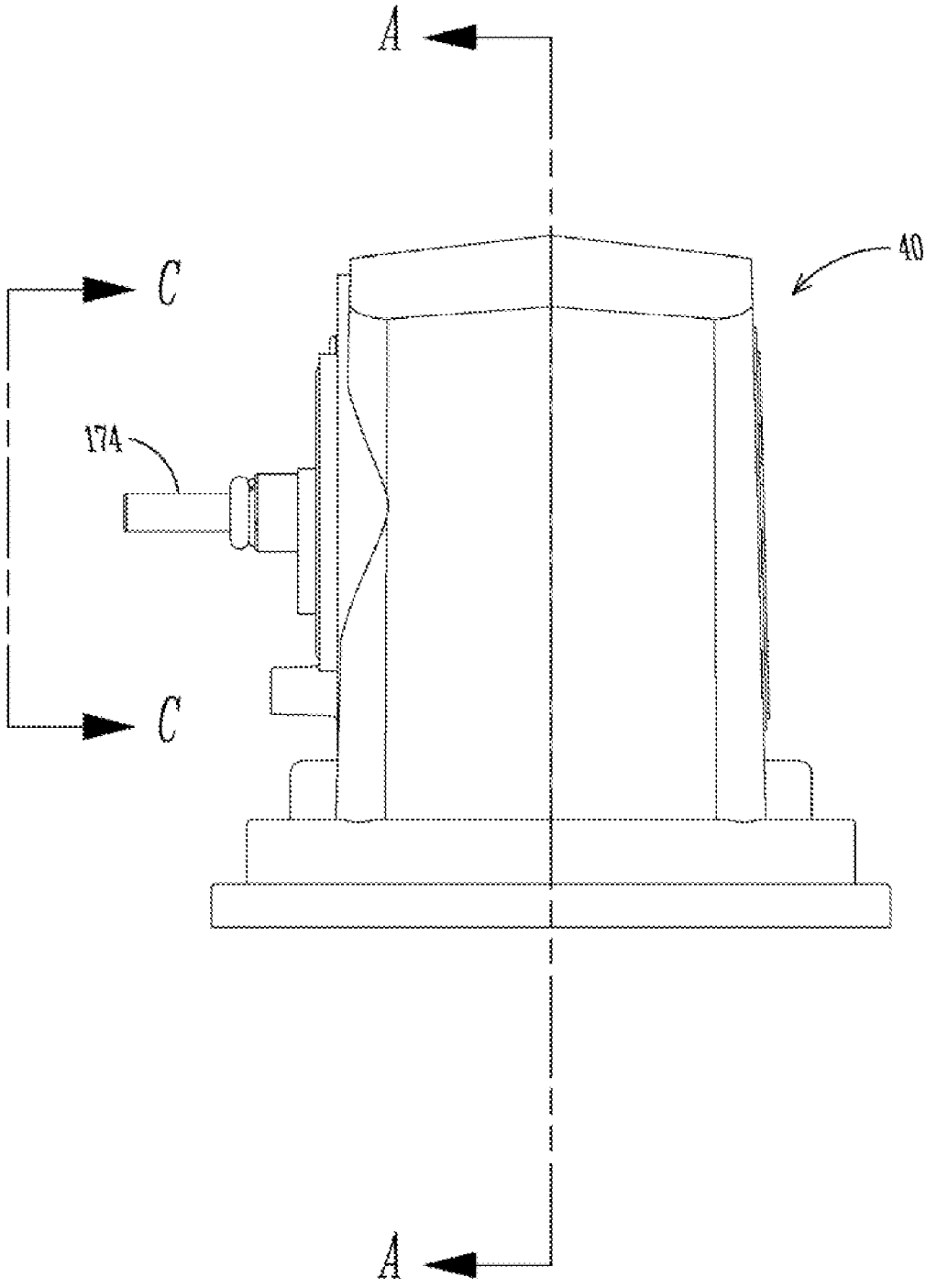
Figure 5F:
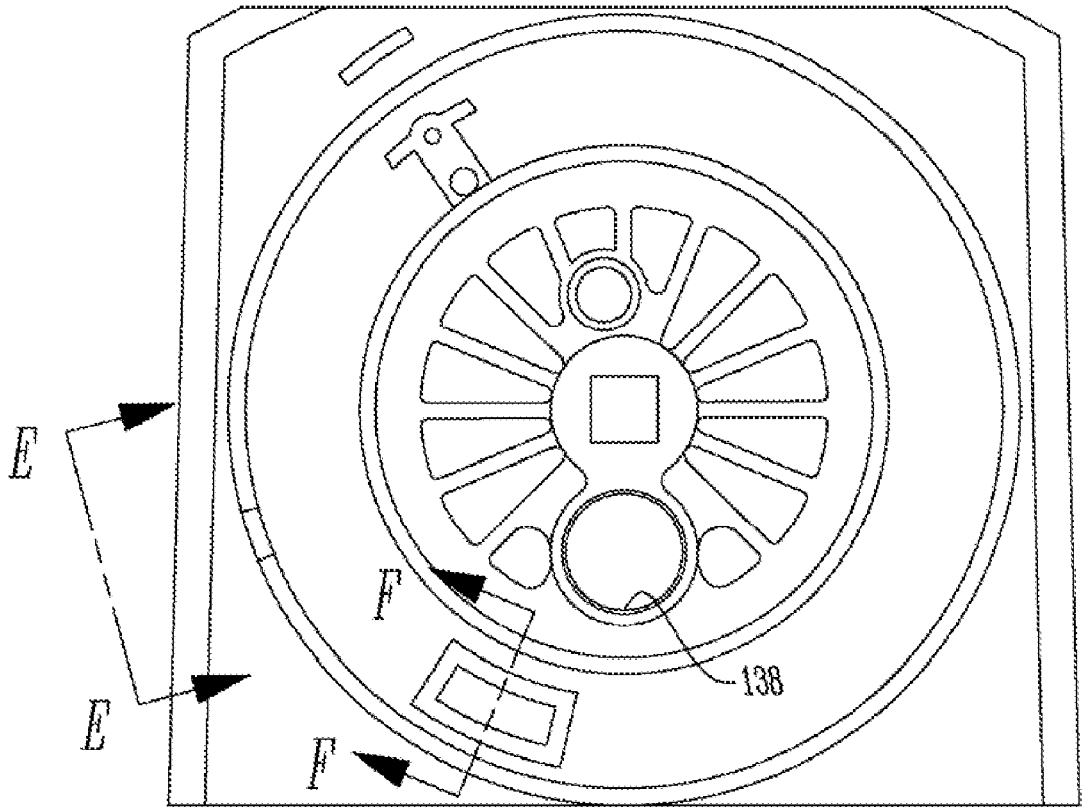
Figure 5H:
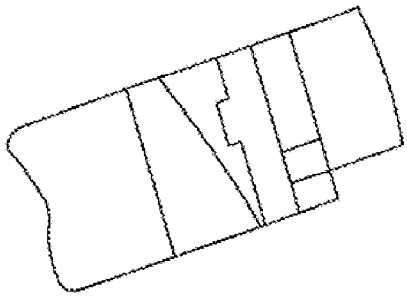
Figure 5I:
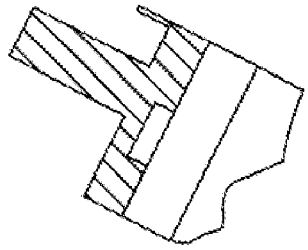
Figure 6A:
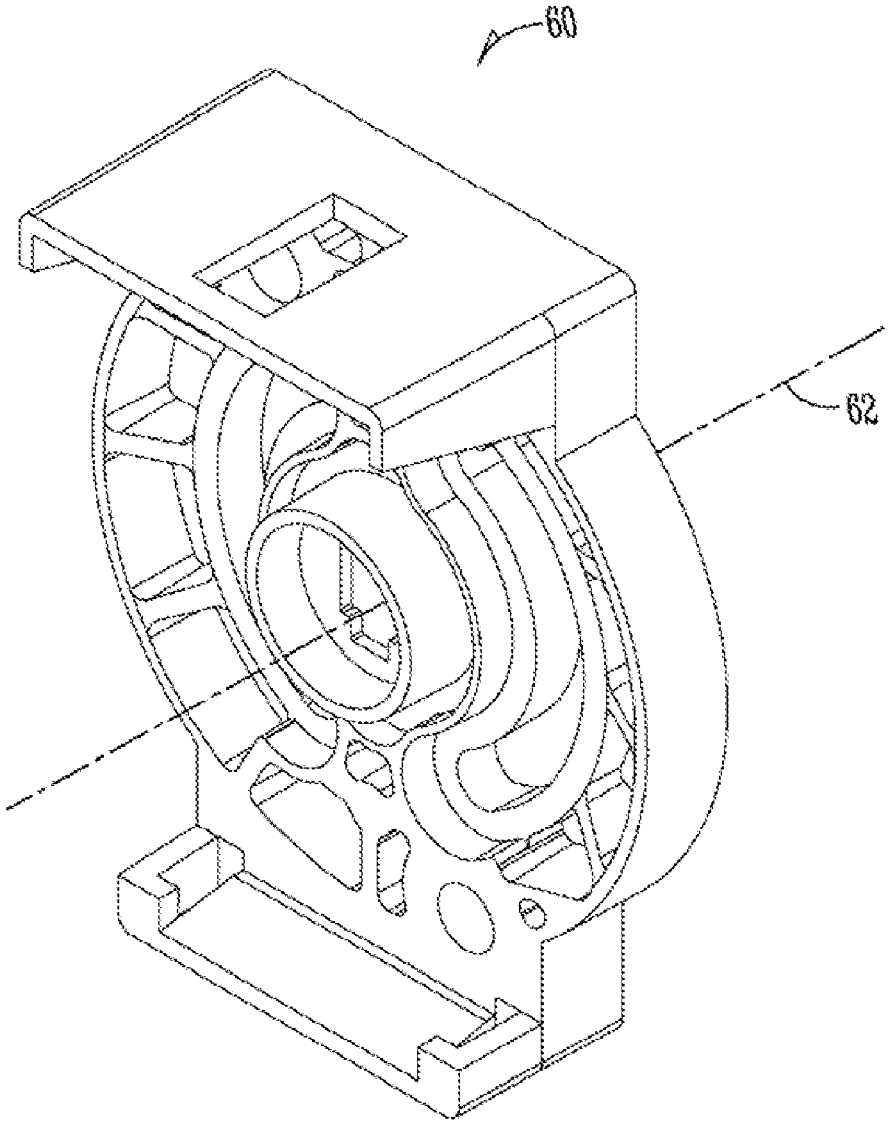
FIGS. 6A-I are various views of an elbow mount for connection to a cross arm on a pole.
Figure 6B:
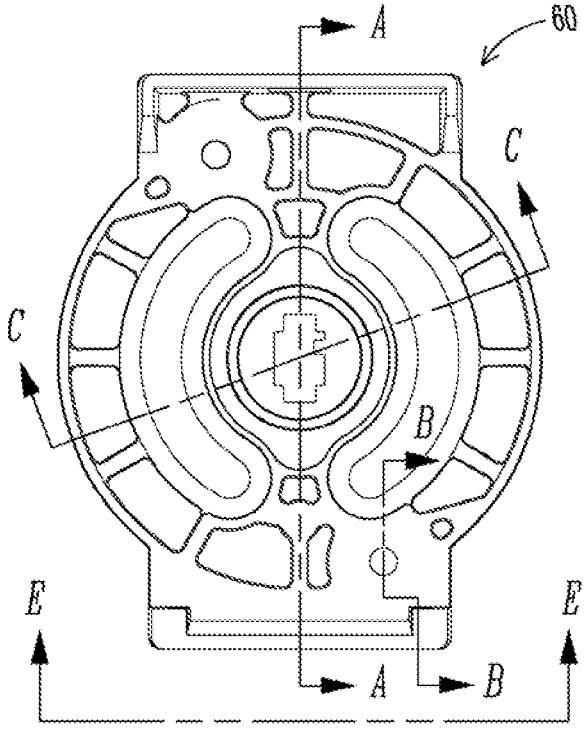
Figure 6C:
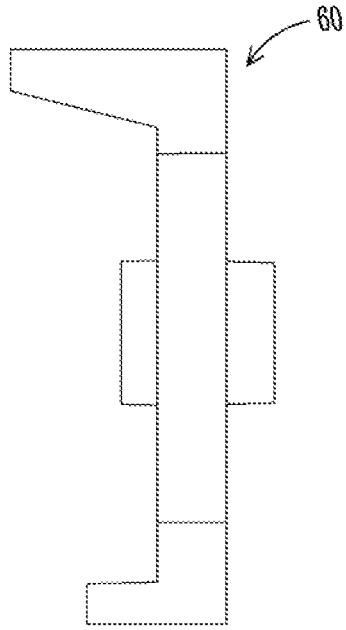
Figure 6D:
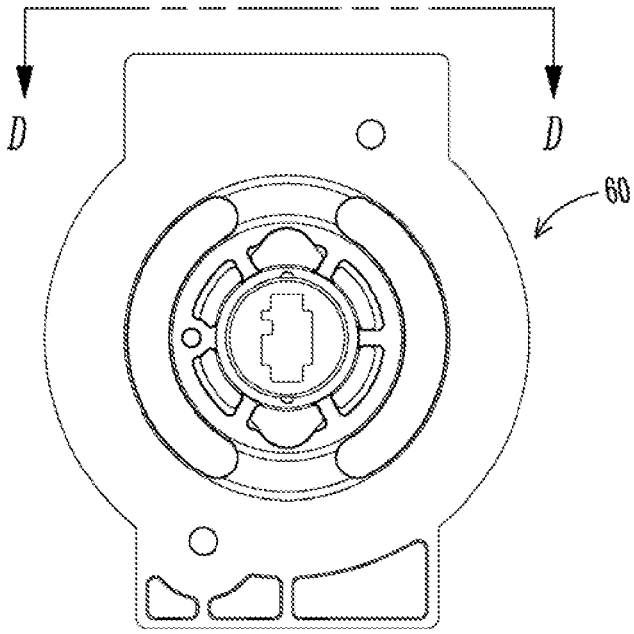
Figure 6G:
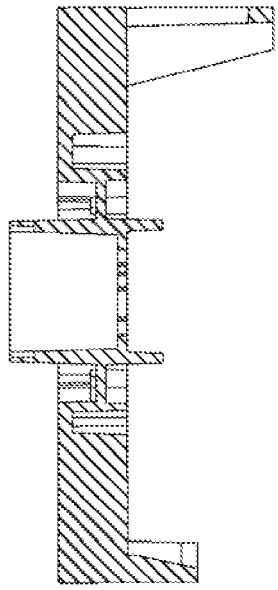
Figure 6E:
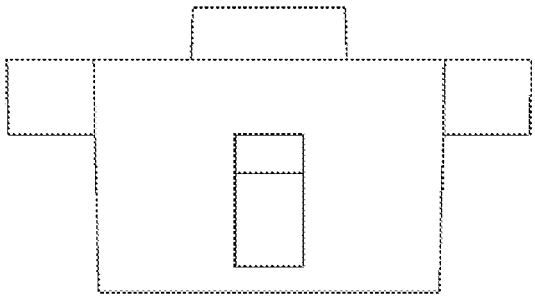
Figure 6F:
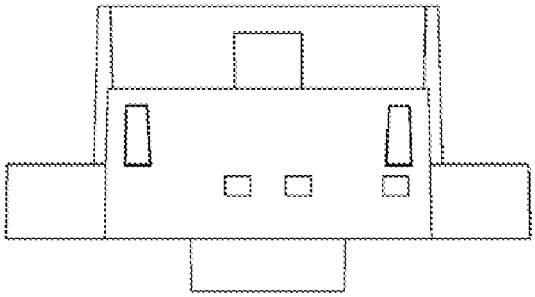
Figure 6H:
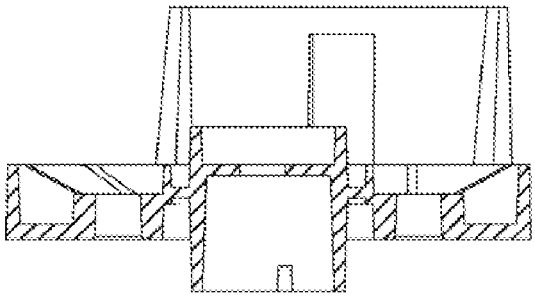
Figure 6I:
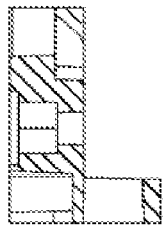

Yoke 80 is pivotally supported at the front of lamp cone 40 at pivot axis 140 (see FIG. 5C arc tube 12). Pivot pins 152 of lamp yoke 80 (see FIG. 14A—and described in more detail below) slide longitudinally into mating receivers 134 (which define pivot axis 140) on opposite sides of opening 132 to lamp cone 40 and are retained in place by yoke retainers 173 (FIGS. 15A-D) by machine screws 175 in the pair of threaded bores on opposite sides of receivers 134 (see FIG. 5J7).

Figure 14D:
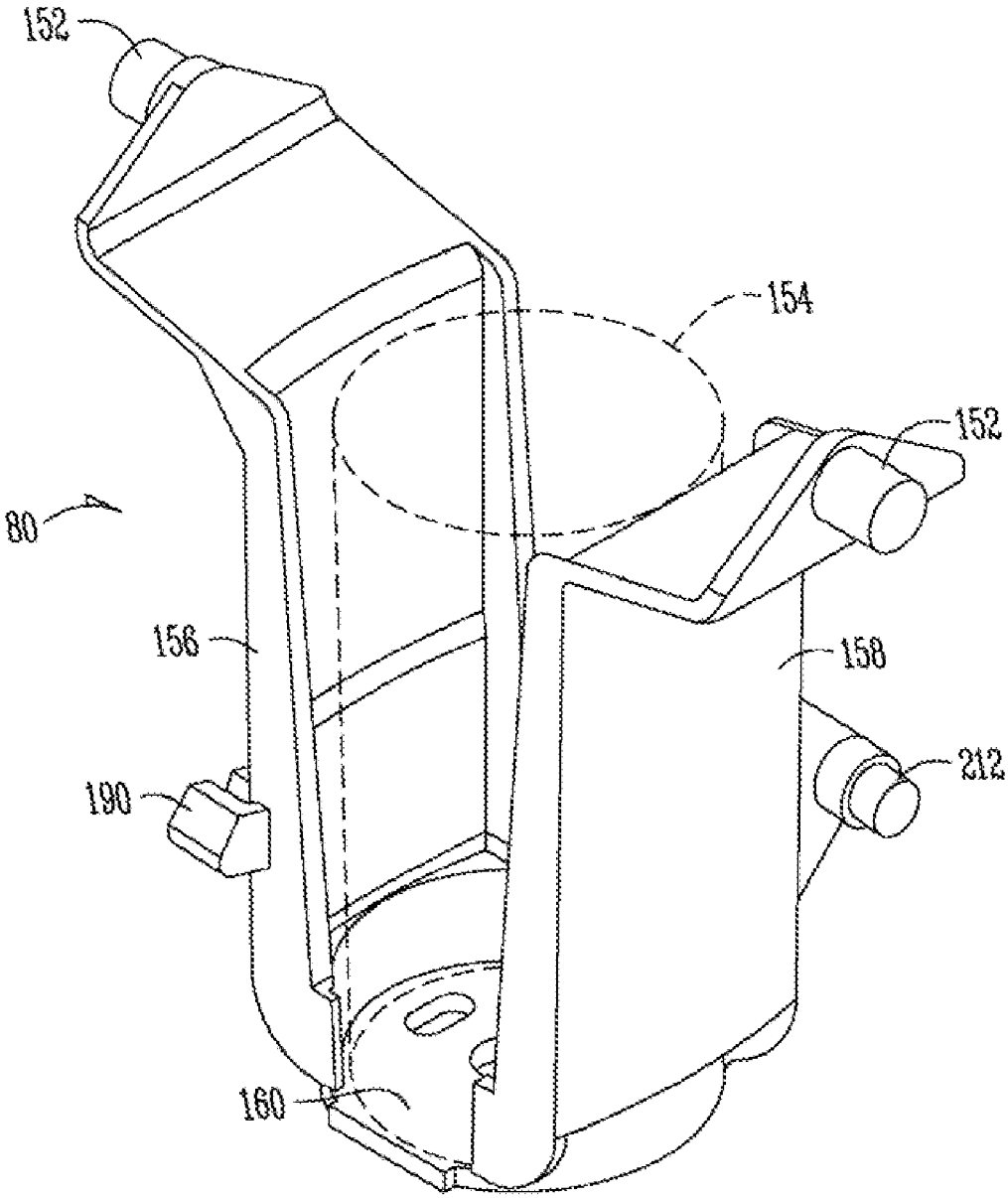
Figure 14E:
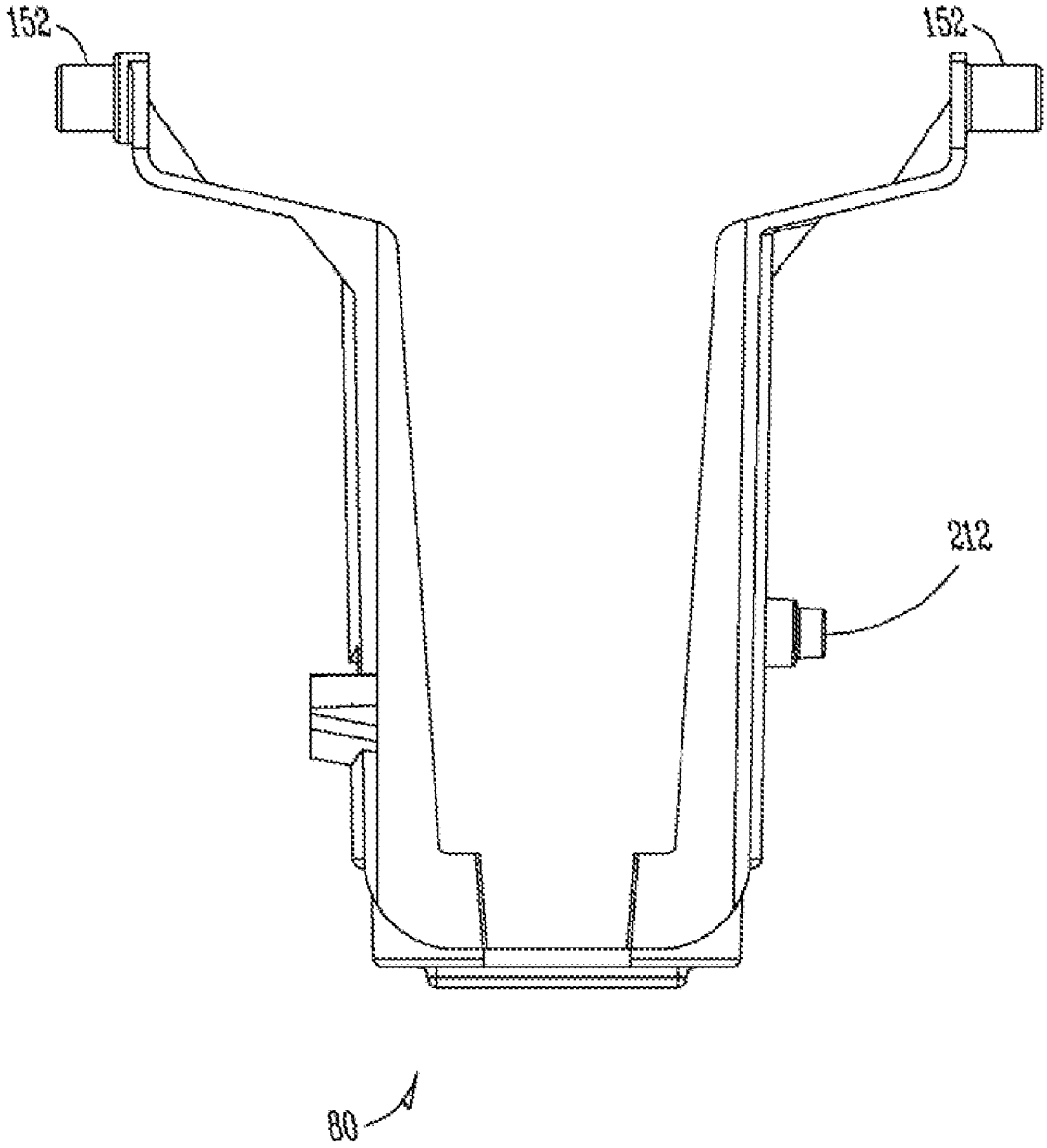
Figure 14F:
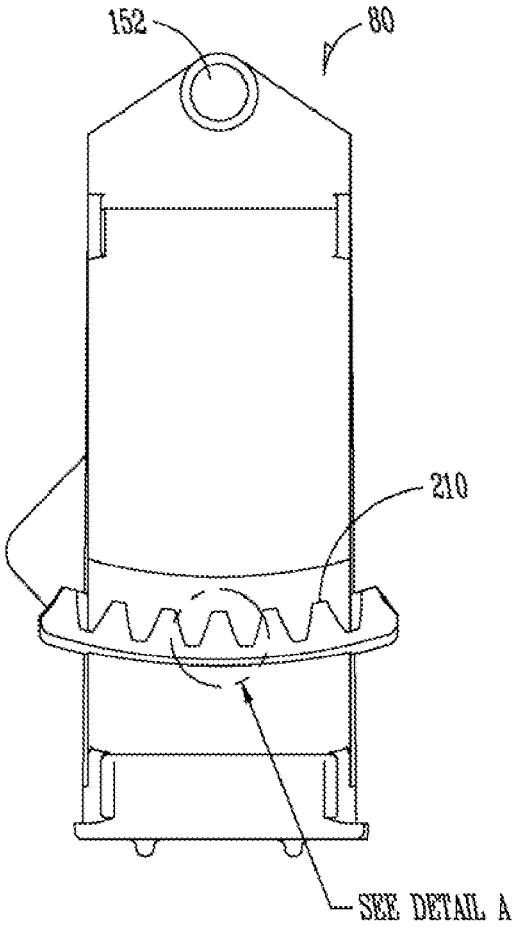

Lamp socket 154 is mounted between arms 156 and 158 of yoke 80 via bolts, screws or other means through the back end 160 of yoke 80. Yoke 80 therefore can pivot around an axis 140 defined by receivers 134 in lamp cone 40. In combination with a setting of gearing, pivotable yoke 80 allows arc tube 12 of arc lamp 20, which is supported by yoke 80, to be maintained in a horizontal position independent of tilt of lamp cone 40. FIGS. 4A-D, along with FIGS. 5A and 14D, illustrate this total tilt factor correction feature of fixture 10.

Pinion gear 202 (FIGS. 8A-D) has a large gear portion 204 spaced parallel from a small gear portion 206 by shaft 208. Shaft 208 is rotatably journaled in opening 138 in the side of lamp cone 40 (offset from the rotational axis of lamp cone 40 relative to knuckle 50). A bushing 203 (plastic sleeve/bushing—FIGS. 9A-E), provides a bearing surface for shaft 208 of gear 202 in opening 138 of lamp cone 40.

Figure 14G:
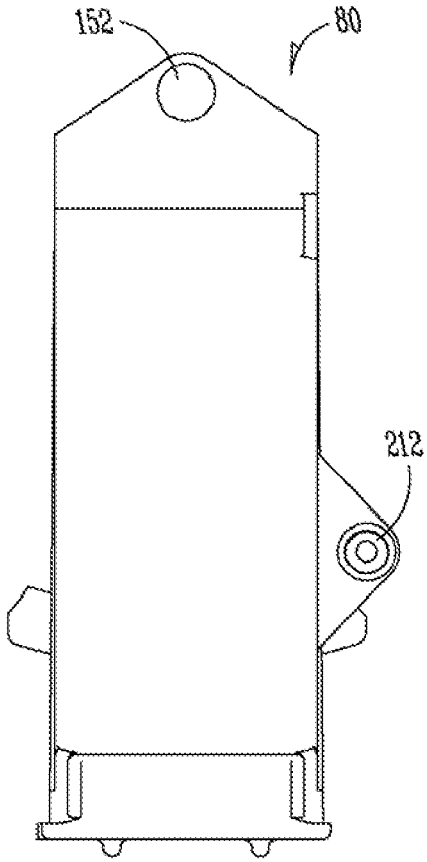
Figure 14H:
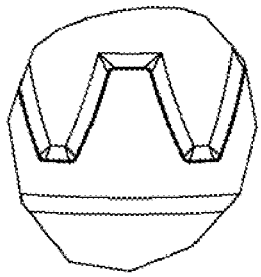
Figure 141:
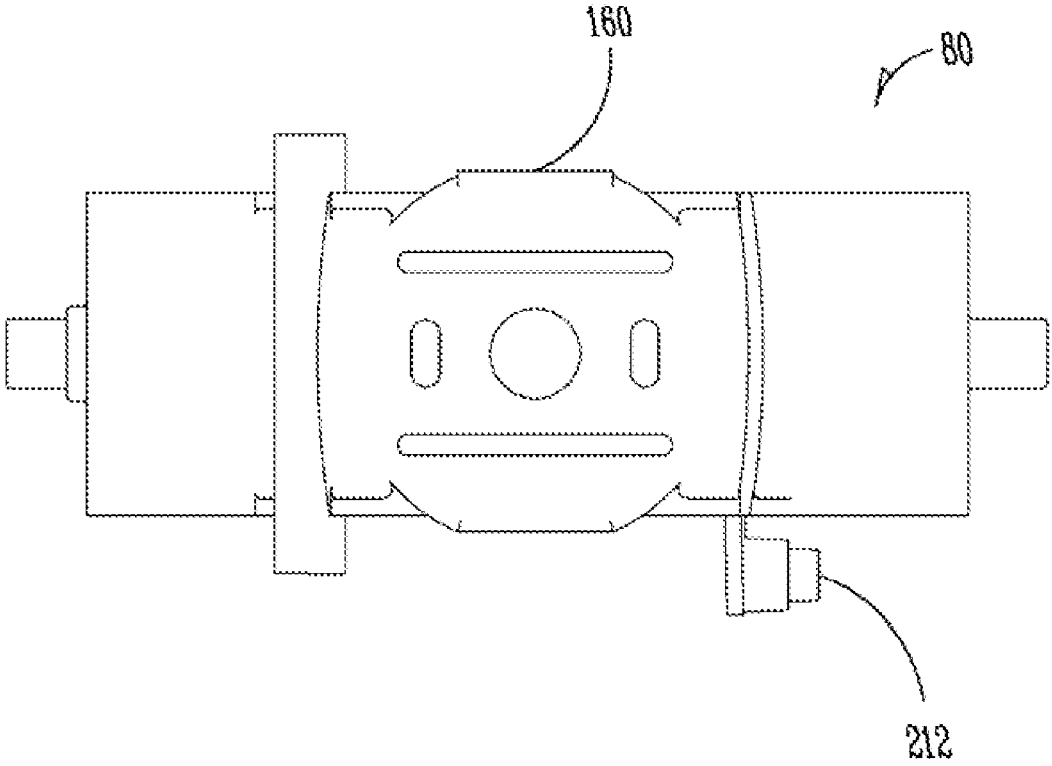
Figure 15A:
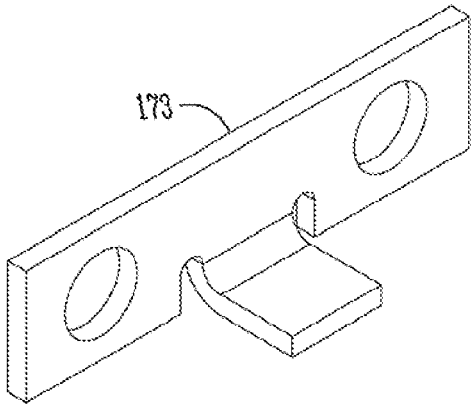
FIGS. 15A-D are views of yoke retainers.
Figure 15B:
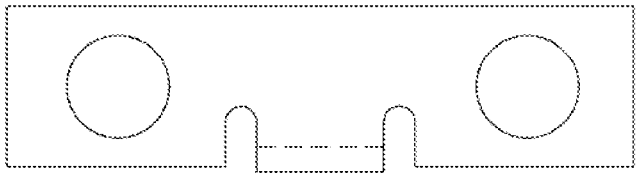
Figure 15C:
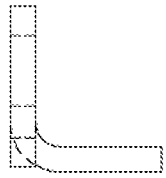
Figure 15D:
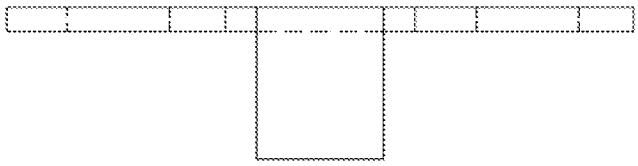

When fixture 10 is assembled, small gear 206 engages gear rack 170 (see FIG. 7G) formed in knuckle 50. Large gear 204, in turn, engages gear rack 190 fixed on one side of yoke 80 (see FIG. 14G). Lamp cone 40 can rotate in a vertical plane around its pivot axis 52 (see FIG. 3) relative to knuckle 50 to allow for different aiming angles for fixture 10 relative to the target. Because the front of yoke 80 (at its pivot axis 140) is fixed relative to lamp cone 40, yoke 80 also rotates in a vertical plane when lamp cone 40 does. If yoke 80 were completely fixed relative to lamp cone 40, the longitudinal axis of lamp 20 would also rotate in a vertical plane. However, this would conflict with the preference to operate arc tube 12 in a horizontal plane regardless of aiming angle of the fixture.

Thus, fixture 10 compensates for this as follows. Gear rack 170 is fixed on knuckle 50. Knuckle 50 is attached to knuckle plate 60 and rotational about axis 62 (see FIG. 3), and knuckle plate 60 is fixed relative to cross arm 7; alternatively, knuckle 50 may be fixed relative to cross arm 7 and omit knuckle plate 60 (see FIG. 2C). The gearing and the parts involved with fixture 10 are selected so that pivotal movement of lamp cone 40 around axis 140 causes a proportional pivoting of yoke 80 around its different pivot axis 52. Placement of yoke pivot axis 140 is intentionally chosen to be at or near the front plane of lamp cone 40. When lamp cone 40 is rotated upward, the front of yoke 80 and pinion gear 202 raise with it, but large gear 206, at the same, lifts the back free end of yoke 80 a proportional amount so that the orientation of lamp 20 and its arc tube 12 remains the same relative to horizontal.

When assembled, longitudinal axis 81 of yoke 80 is aligned or parallel with longitudinal axis 38 of lamp cone 40 (see FIGS. 2C and 4B-D). Thus, when lamp 20 is appropriately mounted on yoke 80, its longitudinal axis would be oblique by the same angle to the longitudinal axes of lamp 20, yoke 80 and lamp cone 40. This is basically a reference position. If lamp cone 40, for example, were tilted 30° down from horizontal relative to cross arm 7 when pole 5 is erected, yoke 80 would also have its longitudinal axis tilted down 30° from horizontal. This would put arc tube 12 in a horizontal plane.

This relationship allows a lamp such as Z-LAMP™ brand lamp 20 (FIGS. 2A-C) to be utilized and operated at a horizontal position, so long as the angular offset of arc tube 12 relative to longitudinal axis 28 of arc lamp 20 is equal to the amount of tilt of lamp cone 40 from horizontal. Thus, if arc tube 12 is tilted 30° to the longitudinal axis of lamp 20 (see, for example, FIG. 2B in which arc tube axis 26 is offset from lamp axis 28), and lamp 20 is rotated into socket 154 of yoke 80 such that the yoke axes and lamp axes are in a vertical plane, arc tube 12 will be horizontal when lamp cone 40 is tilted 30° down from horizontal. As previously described, operation of arc tube 12 at horizontal will correct tilt factor.

However, because not all fixtures will be aimed at 30° down from horizontal, yoke 80 automatically adjusts to maintain the orientation of yoke 80 relative to horizontal for a selected range (e.g., 15° up to 47° down in steps in the plane of knuckle 50) of pivoting of lamp cone 40 on either side of the reference position (e.g., 30° down).

This automatic tilt factor correction is further illustrated at FIGS. 4A-D. If lamp cone 40 is tilted up several degrees from its 30° reference position relative to horizontal, pinion gear 202 will rotate in opening 138 of lamp cone 40 in a counter-clockwise direction as viewed in FIG. 4C. Gear track 170 is fixed with respect to knuckle 50, and with respect to space. The tilting of lamp cone 40 is about its rotational axis 52 (see FIG. 3), which is also stationary in space. The front of lamp cone 40, and thus the front of yoke 80, will move upward in an arc (see reference number 302, FIGS. 4A-D). Pinion gear 202 likewise will move upward in an arc (ref. no. 304). However, the counter-clockwise rotation of pinion gear 202 means large gear 204 will concurrently rotate counter-clockwise. Because large gear 204 is fixed relative to lamp cone 40, the counter-clockwise rotation of large gear 204 will cause gear rack 190 to move in an a still third arc (ref. no. 306) inside lamp cone 40 vertically upward separately from the vertical upward movement of lamp cone 40. Thus, the back of yoke 80 will pivot upwardly along with gear track 190 an amount proportional to the amount lamp cone 40 is pivoted upwardly because gear rack 190 is fixed to yoke 80. A similar proportional downward movement of the back of yoke 80 will be automatic when lamp cone 40 is pivoted downward (see FIG. 4D). However, the amount of movement of the back of yoke 80 is less than the amount of movement of lamp cone 40 because the back of yoke 80 is closer to the pivot axis of lamp cone 40.

In this embodiment, the range of tilt up and below horizontal (the arc tube reference position) is approximately +15 to −60°. This covers most conventional sports lighting aiming angles (95% of them at 30° beam and reference axes). It is noted that the guiding factor for operation of the automatic tilt factor correction is the pivot location of yoke 80. It works as described because it is basically in the same plane as the junction between lamp cone 40 and reflector frame 30. It would be more difficult to get precise correction if the yoke was pivoted to lamp cone 40 nearer the back of lamp cone 40. While some change between the position of arc lamp 12 and reflecting surfaces 72 of fixture 10 occurs, it is relatively small. Thus minor re-aiming, if any is needed.

The gear ratios (large and small gears 204 and 206 have the same number of teeth are carefully selected such that there will be precise compensation for any upward or downward tilting of lamp cone 40 to maintain the same downward angular orientation of yoke 80. In other words, despite yoke 80 being attached to, and moving with lamp cone 40 when it is pivoted away from its reference position, the gearing causes yoke 80 to pivot to maintain the same orientation relative to horizontal. Because lamp cone 40 pivots about a different axis than yoke 80, selection of the gearing is critical to cause the right proportional movement of yoke 80. Although the actual physical position of yoke 80 relative to lamp cone 40 will change somewhat, the orientation of yoke 80 stays parallel to its reference position. This will allow arc tube 12 of Z-LAMP™ brand lamp 20 to stay horizontal regardless of whether lamp cone 40 is in the reference position or some degree off of the reference position (within the range of the gearing).

Figure 10A:
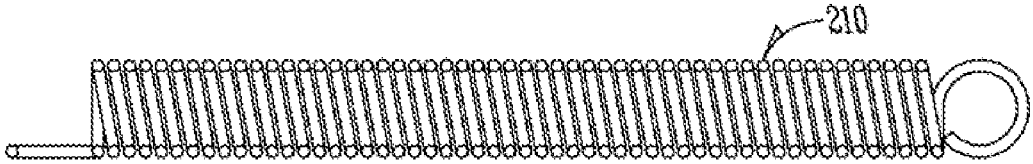
FIGS. 10A-B show a spring used with the preferred embodiment.
Figure 10B:
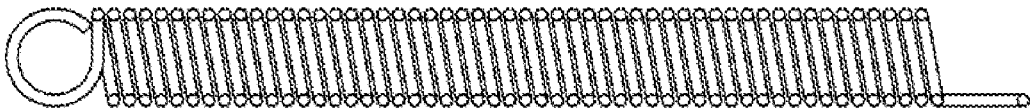

To provide against play and to inject a biasing force relative to yoke 80, an extension spring 210 (see FIGS. 10A-B), attaches between post 212 of yoke 80 and post 214 at the front of lamp cone 40. The spring is selected to maintain a suitable biasing force. It essentially pre-loads the gearing so there is not play in the gears or backlash. This increases the accuracy of the aiming. When maintenance on lamp 10 is performed, spring 120 can be easily disengaged by pulling it off of post 214. The pitch diameter of the last few teeth on large gear 204 are cut off slightly greater than the pitch diameter of the other teeth. This makes that combination less sensitive to reengagement.

Figure 7A:
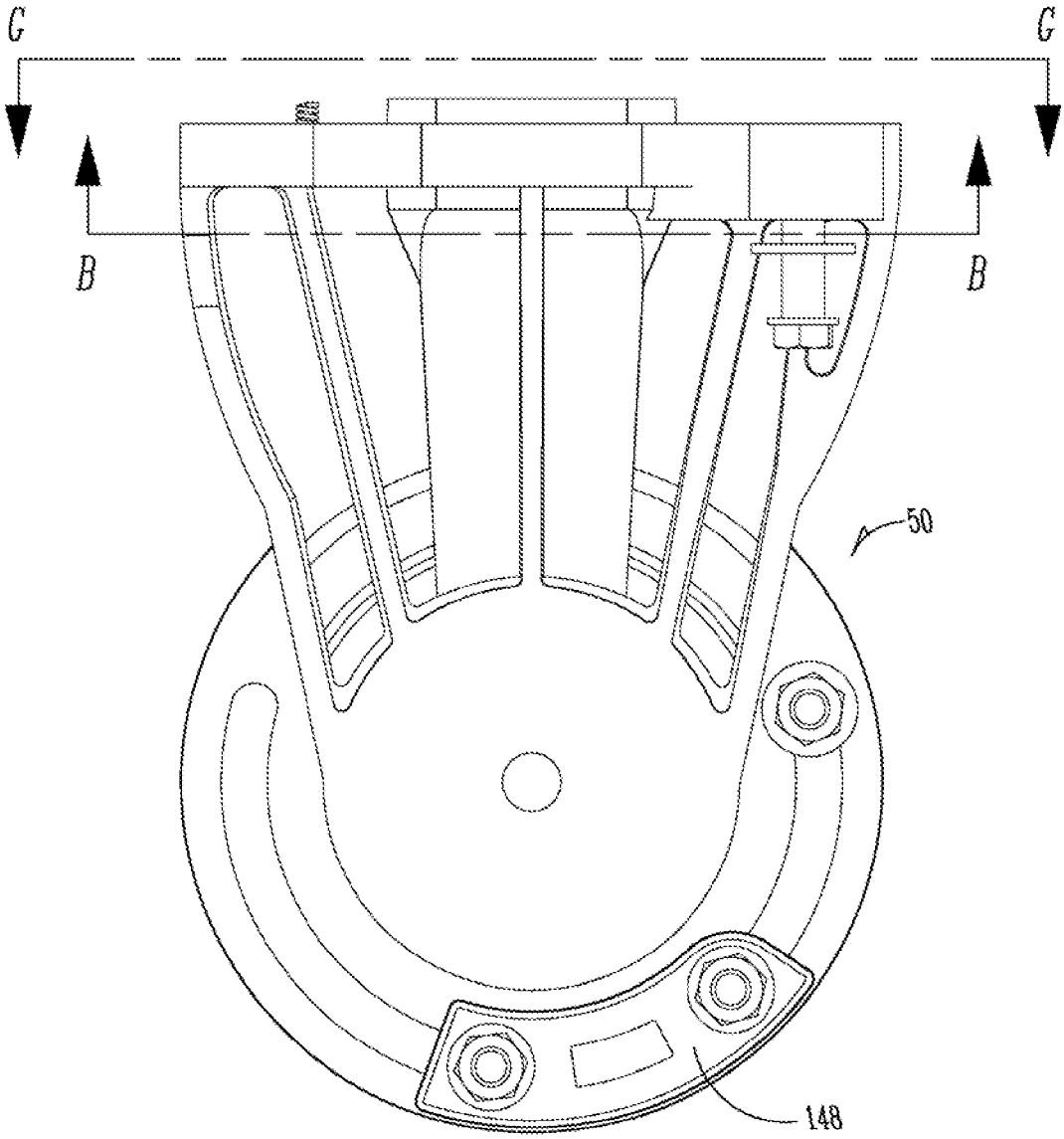
Figure 7B:
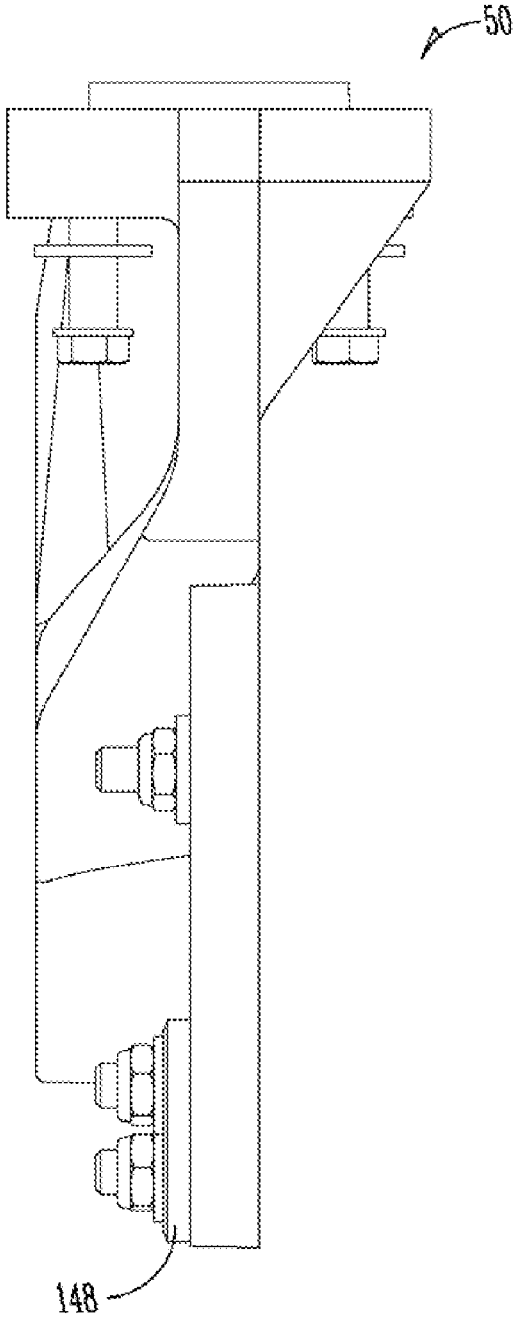
Figure 7C:
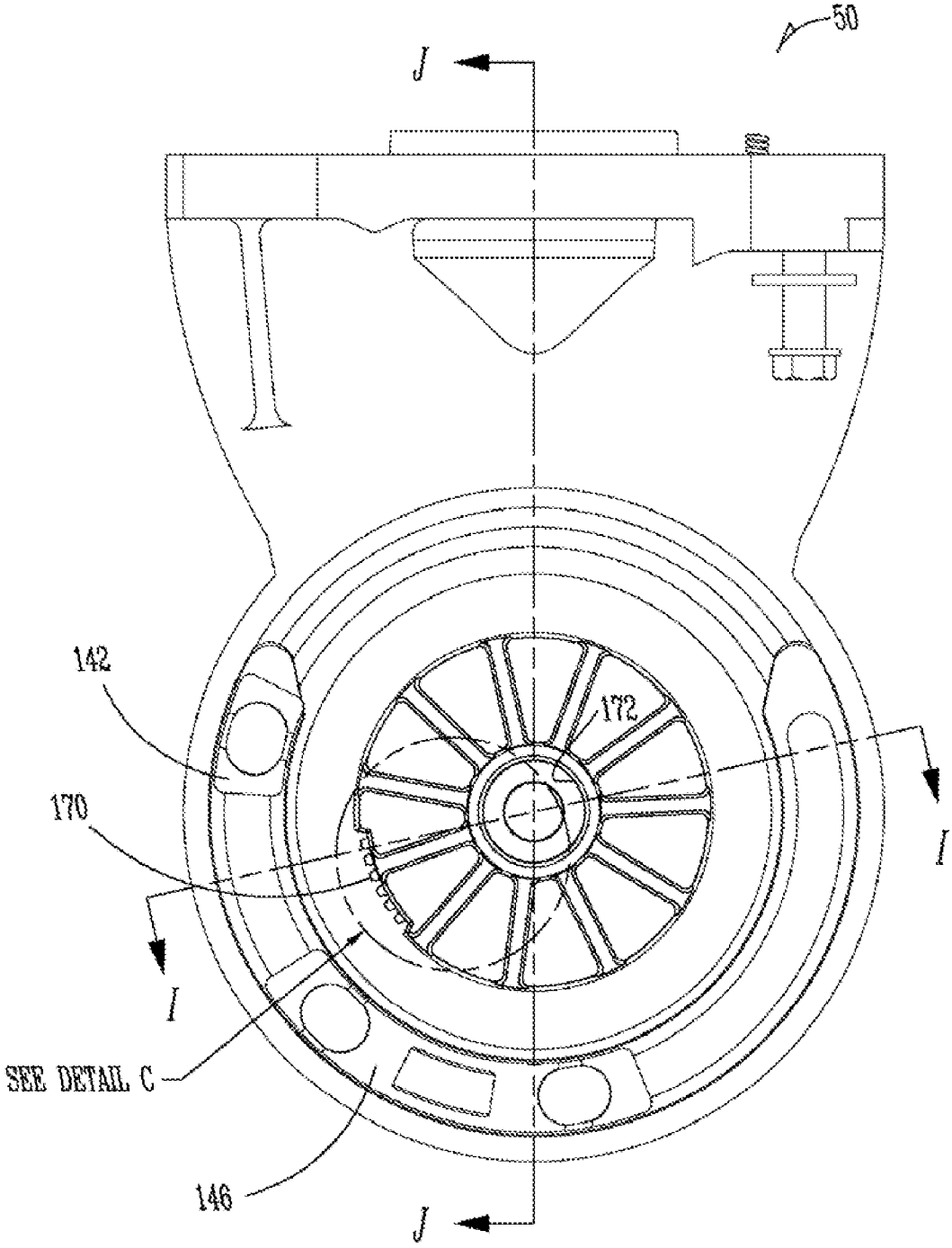
Figure 7G:
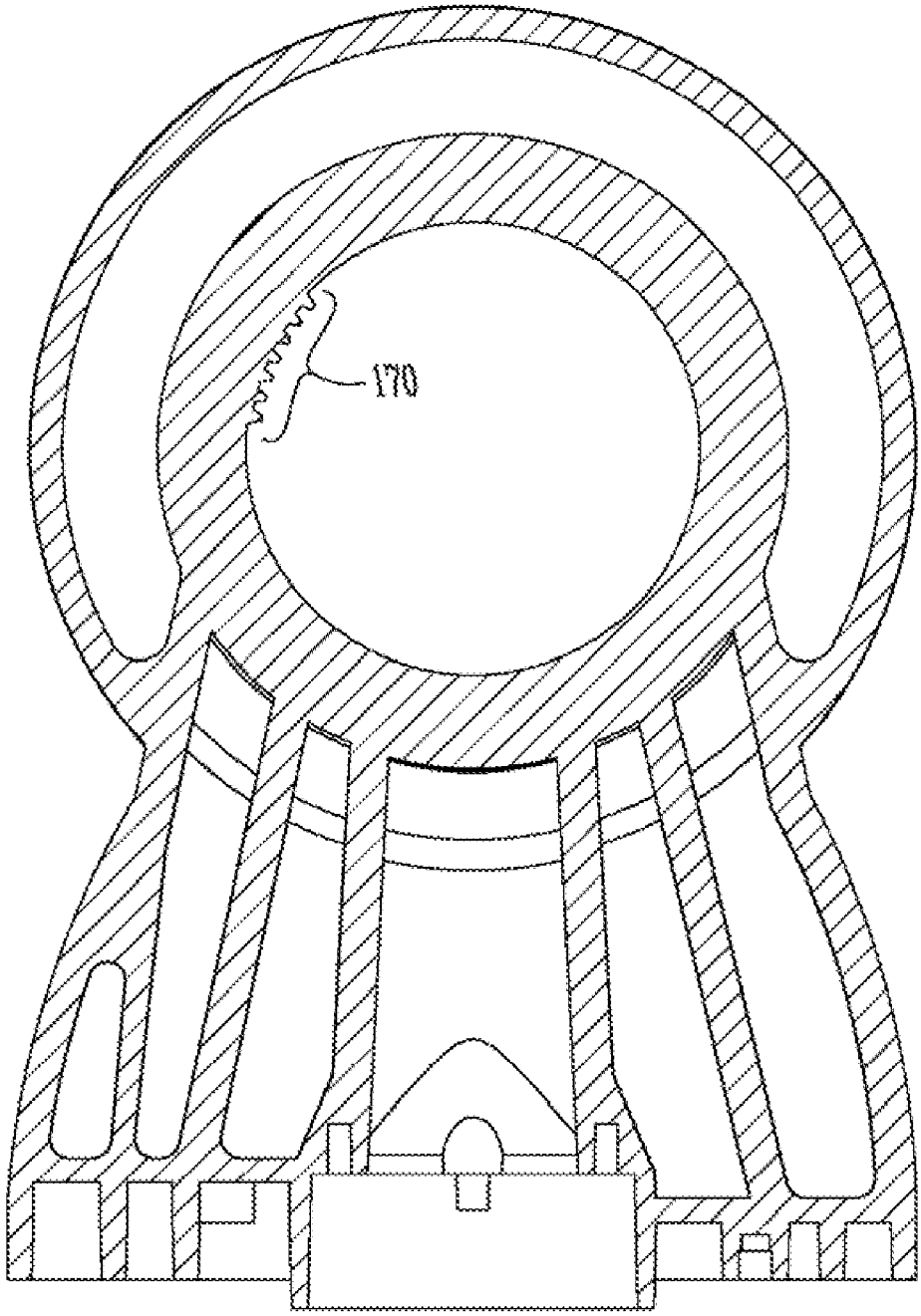
Figure 7I:
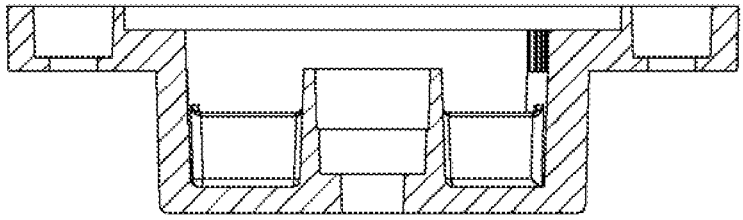
Figure 7J:
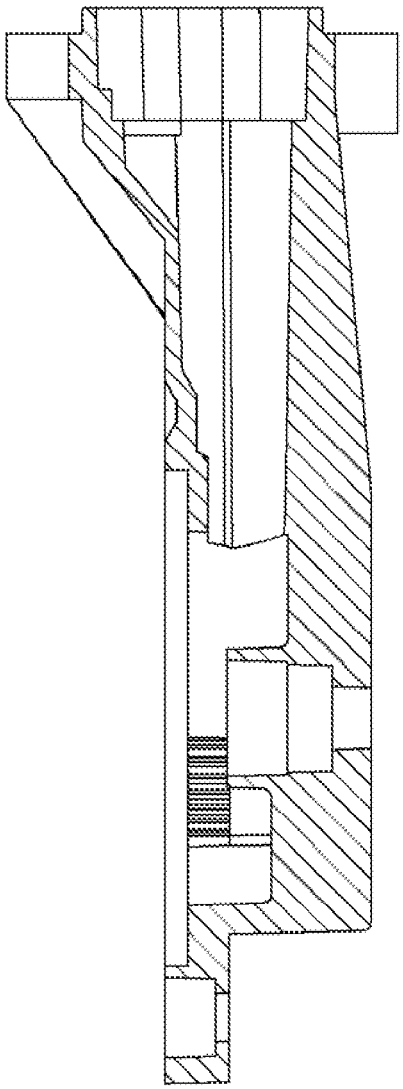
Figure 7H:
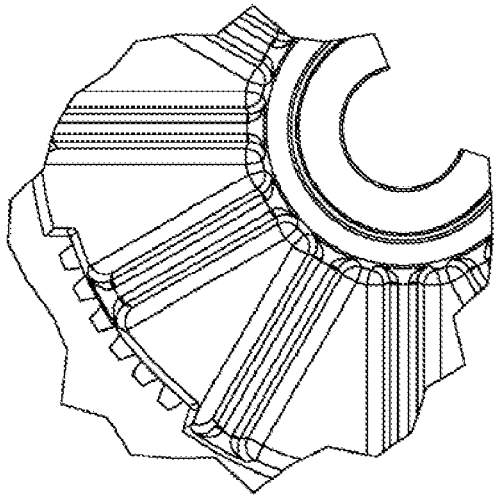
Figure 8A:
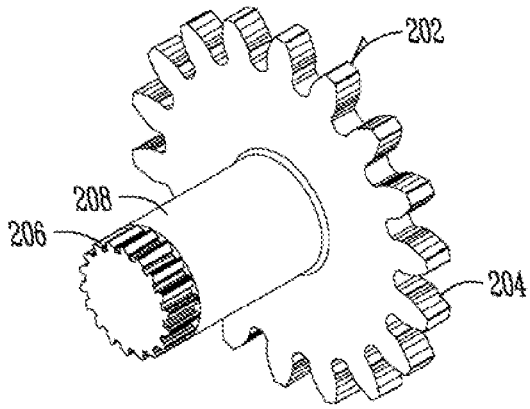
FIGS. 8A-D are various views of a gearing piece useful with the preferred embodiment.
Figure 8B:
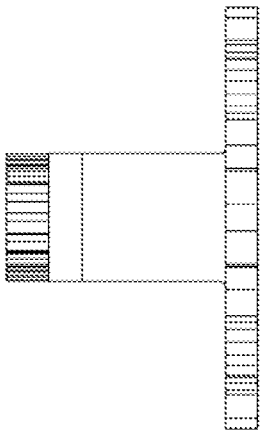
Figure 8C:
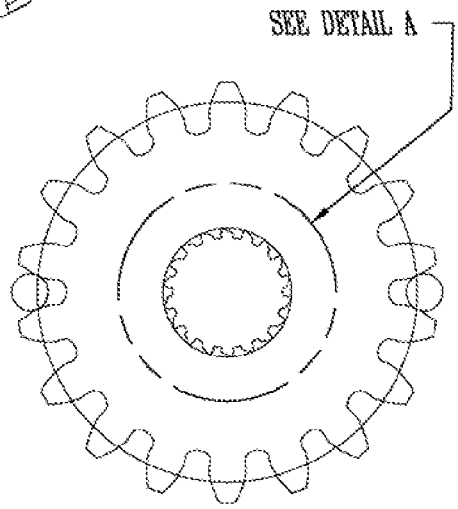
Figure 8D:
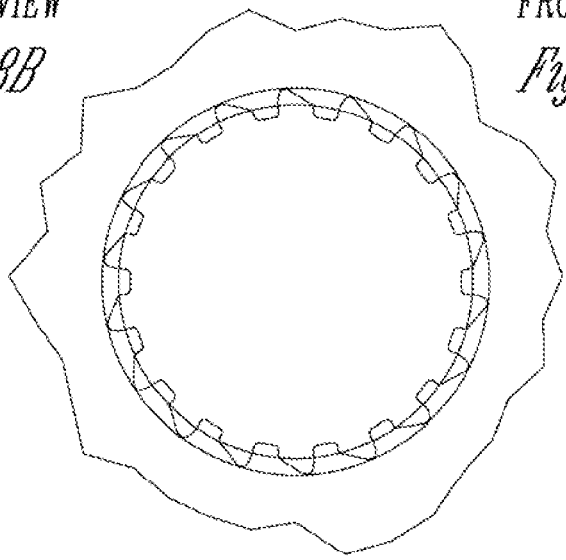
Figure 9A:
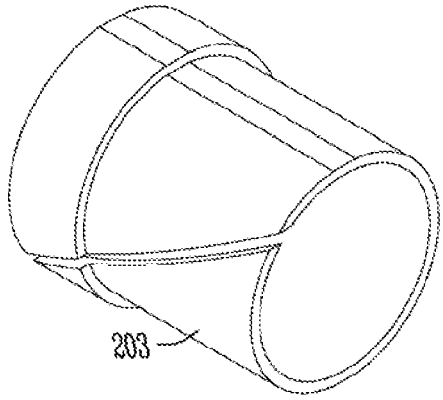
FIGS. 9A-E are various views of a bushing used with a bolt to pivotably connect the elbow and cone.
Figure 9B:
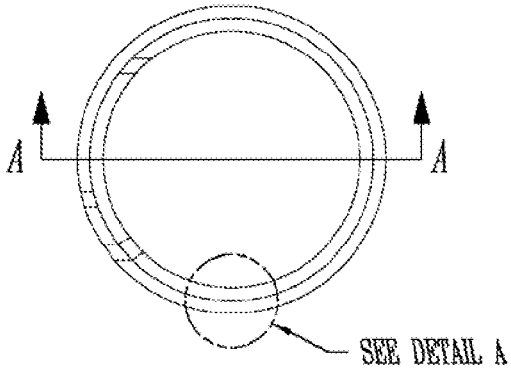
Figure 9C:
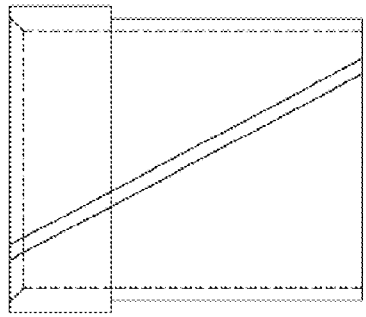
Figure 9D:
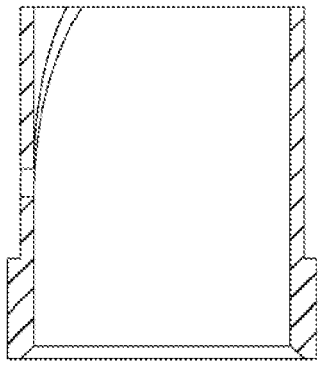
Figure 9E:
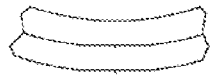
Figure 11A:
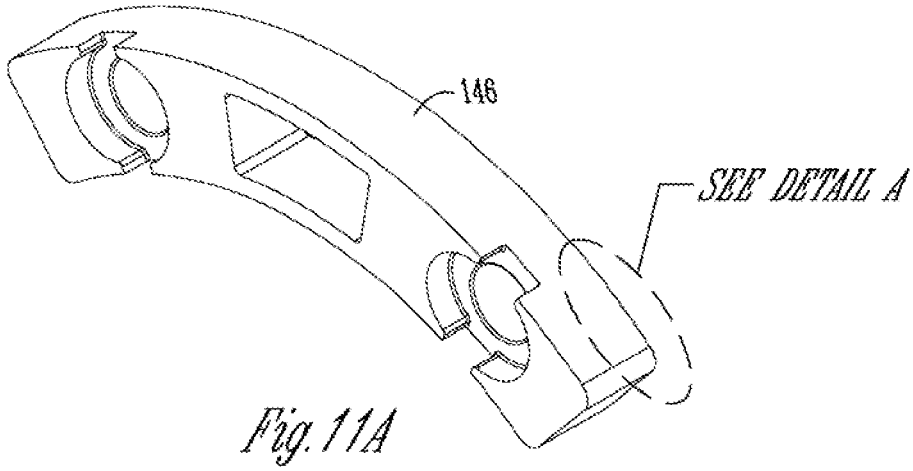
FIGS. 11A-C show a strap member used to lock the cone to the elbow.
Figure 11B:
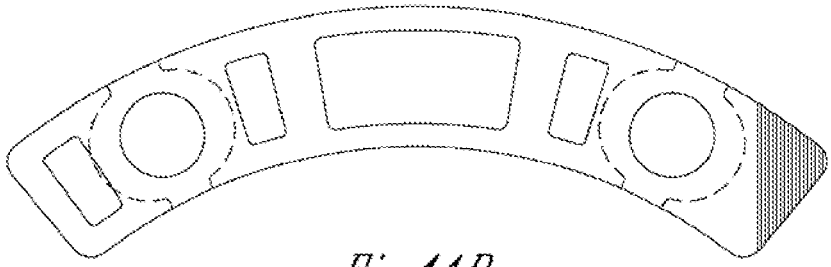
Figure 11C:
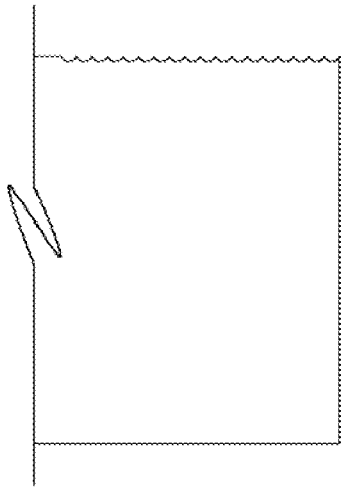
Figure 12A:
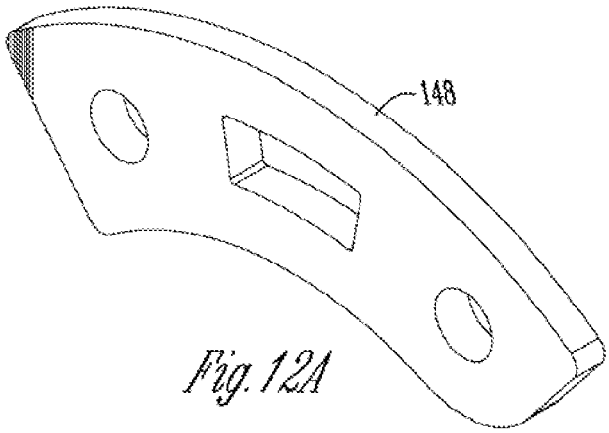
FIGS. 12A-F show additional straps used for such locking.
Figure 12B:
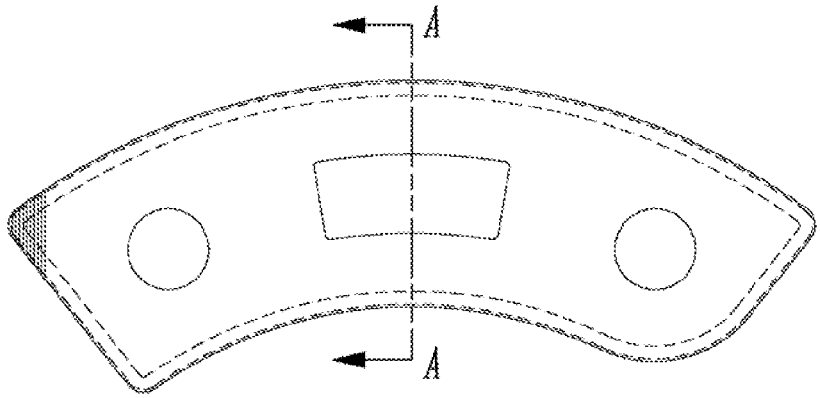
Figure 12C:
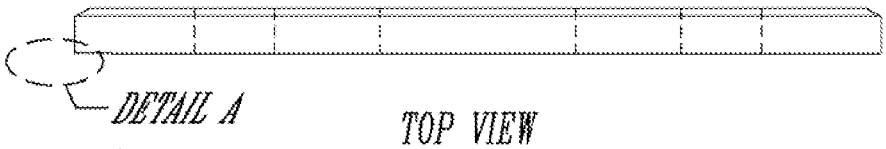
Figure 12D:
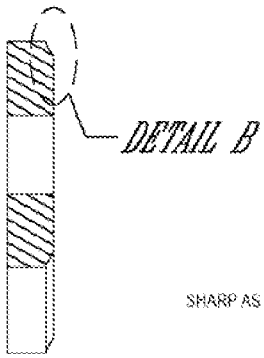
Figure 12E:
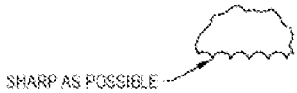
Figure 12F:
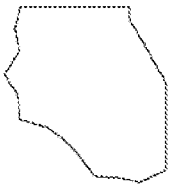
Figure 13A:
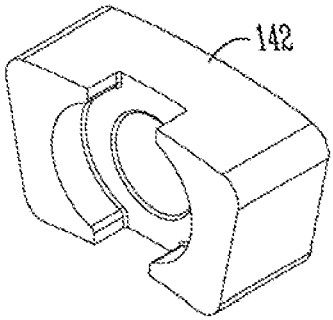
FIGS. 13A-F show an end stop also used for adjustable locking of the angular orientation of the cone to the elbow.
Figure 13B:
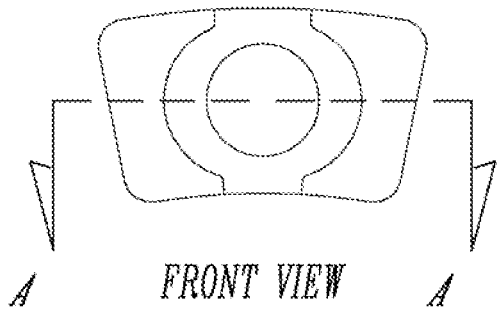
Figure 13C:
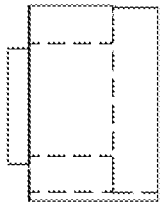
Figure 13D:
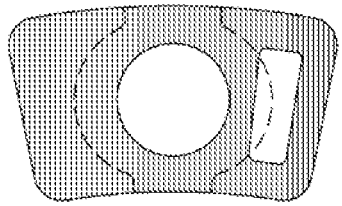
Figure 13E:
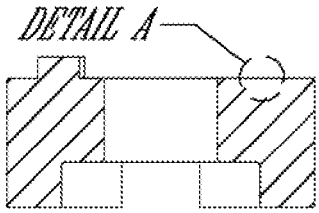
Figure 13F:
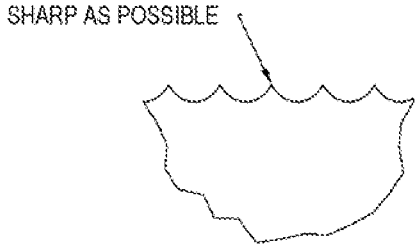

FIGS. 11, 12, and 13 show what is called straps and an end stop that can be clamped along the curved slot in knuckle 50 (see FIGS. 7A-C). A projection from the side of cone 40 extends into that curved slot when cone 40 is pivotally connected to knuckle 50 by bolt 174. The angular orientation of cone 40 relative to knuckle 50 can therefore be set by where strap pair 146/148 is clamped in position (as a lower end stop), and where end stop 142 is positioned and clamped in place (as an upper end stop). This combination provides more holding power to withstand torque forces than just relying on the tightening of bolt 174. The straps and end stop can have structure that allow them to be clamped in place along the curved channel by tightening of bolts. Additionally, it allows for relatively easy release of the position for cone 40. Two bolts on the straps for the bottom end stop can simply be released and that end strap pair slid away. This would allow, for example, a maintenance crew to go up and work on a fixture. The lower end stop straps could be released and the fixture tilted down to hang vertically while they worked on it. By leaving the upper end stop clamped into position, when finished, the workers just pivot the lamp and cone 40 back until into abutment with the upper end stop, slide the lower end stop strap pair into abutment with the projection or boss from the end cone that is in the slot, and retighten the screws. The original aiming of the fixture is therefore retained. It avoids having to do any re-aiming or calibrations.

As discussed above, one feature of the invention is maintaining an orientation of lamp 20 relative to some reference position substantially independent of the pivoting of cone 40. As can be appreciated, the exemplary embodiment does this with the multiple pivot axes and gearing. This arrangement, however, while maintaining its substantially consistent orientation of the lamp with some external reference plane does cause slight movement of the lamp relative to the reflector that is attached to cone 40. This can slightly alter the beam pattern from the fixture. For example, if cone 40 is tilted upwardly approximately 15° from a 30° down position, not only would the reflector connected to the cone tilt up 15°, the repositioning of the lamp inside the reflector would cause a beam shift an additional approximately 7½ more degrees up. Being aware of this, and compensating for this, is sometimes required. However, because of fairly known proportionalities once a configuration is selected, this can be built into the design of the system. It actually can be advantageous in that even though there might be some physical limit of how far up or down cone 40 can be adjusted (for example because of physical limitations in the structure of the fixture or for that matter, practical limitations), the beam shift created by that adjustment is proportionally more, thus giving a wider range of potential adjustments.

Further discussion of benefits of the total tilt factor correction structure and options for it can be found in the patents incorporated by reference herein.

It will be appreciated that the foregoing exemplary embodiment is given by way of example only and not by way of limitation. Variations obvious to those skilled in the art will be included in the invention. The scope of the invention is defined solely by the claims.

Utilization of the Musco Z-LAMP™ brand lamp is not necessarily required. By appropriate modification, a standard arc lamp could be utilized.

It will be appreciated that the combination of components shown in the figures is but one way in which adjustability between a mount for the fixture to a cross arm, and the fixture can be accomplished. The figures illustrate how, in the exemplary embodiment, an integration of the gearing and the adjustable yoke allows for compensation and maintenance of an orientation of the arc lamp regardless of orientation vertically of the cone in which the yoke is contained (over a reasonable range). The drawings are intended to show to one skilled in the art one combination. The general concept is to have some compensation or mechanism for the function and result of maintaining a certain orientation of the lamp.

What is claimed is:

1. A method of increasing useful light to a target area from lighting fixture including a high intensity discharge light source comprising:

a. installing the lighting fixture in operating position relative the target area; and b. automatically approximately maintaining an orientation of the high intensity discharge light source relative to the target area regardless of orientation of the lighting fixture to the target area.

2. The method of claim 1 further comprising mounting the light source in a structure that is independently moveable relative to the lighting fixture.

3. The method of claim 2 wherein the independently moveable structure is pivotable relative to the light fixture.

4. The method of claim 3 wherein the independently moveable structure is pivotable relative to the light fixture on a separate pivot axis from that of the light fixture.

5. The method of claim 4 wherein any change of orientation of the light fixture, over a certain range, results in proportional pivoting of the independently moveable structure.

6. The method of claim 5 wherein the proportional movement is through gearing.

7. A lighting fixture for wide area lighting comprising a lamp cone adapted to receive high intensity discharge light source and a knuckle connectable to the lamp cone, the lamp cone being pivotable around a first pivot axis relative to the knuckle, comprising:

a. a lamp yoke in the cone to which a high intensity discharge light source can be mounted and which is pivotable around a second pivot axis;

b. a gearing combination operably connected to the lamp yoke to pivot the lamp yoke around the second pivot axis proportionally to any pivoting of the lamp cone relative the knuckle around the first pivot axis.

* * * * *

UNITED STATES PATENT AND TRADEMARK OFFICE

CERTIFICATE OF CORRECTION

PATENT NO. : 7,736,024 B2
APPLICATION NO. : 12/165212
DATED : June 15, 2010
INVENTOR(S) : Gordin et al.

It is certified that error appears in the above-identified patent and that said Letters Patent is hereby corrected as shown below:

Col. 3, line 9:
DELETE after Corporation "LAMP™"
ADD after Corporation -- Z-LAMP™ --

Col. 5, line 13:
ADD after any -- , --

Signed and Sealed this

Twenty-first Day of September, 2010

David J. Kappos

David J. Kappos
*Director of the United States Patent and Trademark Office*

UNITED STATES PATENT AND TRADEMARK OFFICE

CERTIFICATE OF CORRECTION

PATENT NO. : 7,736,024 B2
APPLICATION NO. : 12/165212
DATED : June 15, 2010
INVENTOR(S) : Gordin et al.

It is certified that error appears in the above-identified patent and that said Letters Patent is hereby corrected as shown below:

On the Title Page, Item (73):
DELETE after Assignee: "Mucso Corporation"
ADD after Assignee: --Musco Corporation--

Signed and Sealed this
First Day of July, 2014

Michelle K. Lee

Michelle K. Lee
*Deputy Director of the United States Patent and Trademark Office*